US007559641B2

(12) United States Patent
Nishida et al.

(10) Patent No.: US 7,559,641 B2
(45) Date of Patent: Jul. 14, 2009

(54) IMAGE RECORDING APPARATUS

(75) Inventors: Toru Nishida, Ebina (JP); Hiroaki Satoh, Ebina (JP); Akira Mihara, Ebina (JP); Kiyoshi Hosoi, Ebina (JP); Satoshi Mohri, Ebina (JP); Toyoji Ushioda, Ebina (JP); Takeshi Zengo, Ebina (JP); Koichi Saitoh, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 455 days.

(21) Appl. No.: 11/203,874

(22) Filed: Aug. 15, 2005

(65) Prior Publication Data

US 2006/0209153 A1 Sep. 21, 2006

(30) Foreign Application Priority Data

Mar. 17, 2005 (JP) ..... 2005-077908

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS 5,886,722 A * 3/1999 Kuehnle ..... 347/104
5,931,589 A * 8/1999 Kamano et al. ..... 400/629
6,250,754 B1 * 6/2001 Bortolotti ..... 347/104
6,406,141 B2 * 6/2002 Yosimura et al. ..... 347/102
6,585,350 B2 * 7/2003 Barinaga ..... 347/33
6,728,012 B2 * 4/2004 Bacher et al. ..... 358/498
2005/0073569 A1 * 4/2005 Obregon et al. ..... 347/104

* cited by examiner

*Primary Examiner*—Stephen D Meier
*Assistant Examiner*—Alexander C. Witkowski
(74) *Attorney, Agent, or Firm*—Fildes & Outland, P.C.

(57) ABSTRACT

An image recording apparatus is disclosed wherein an image is recorded on a recording medium based on image information by ejecting liquid droplets from a liquid droplet ejecting head. A liquid droplet ejecting head is provided which has an ejection region substantially corresponding to a width of the recording medium. A conveyor unit is provided which conveys the recording medium to the ejection region of the liquid droplet ejecting head with the recording medium attracted and attached thereto and supported thereon. The recording medium is fed from the conveyor unit to a paper discharge section. Further, a plurality of attracting and supporting subunits are provided which are vertically moved with the recording medium, which is delivered thereto from the conveyor unit, attracted and attached thereto and supported thereon, thereby conveying the recording medium to a subsequent step.

16 Claims, 30 Drawing Sheets

202
204
206
210
214

IMAGE RECORDING APPARATUS

CROSS-REFERENCE TO RELATED APPLICATION

This application claims priority under 35 USC 119 from Japanese Patent Application No. 2005-77908, the disclosure of which is incorporated by reference herein.

BACKGROUND OF THE INVENTION

1. Field of the Invention

The present invention relates to an image recording apparatus, and more particularly it pertains to an image recording apparatus which is structured such that an image is recorded by ejecting liquid droplets from a liquid droplet ejecting head onto a recording medium.

2. Description of the Related Art

A printer using a so-called "full width array" (FWA) inkjet recording head which covers the entire width of the recording paper can realize remarkably high speed printing since it does not perform main-scanning, as compared with a so-called serial type inkjet printer.

Inkjet printers are predominantly of the type that prints by ejecting water-soluble ink droplets containing a large proportion of water for the reason that use of an oil-base ink or a solvent-type ink can be significantly detrimental to the environment. When such a water-soluble ink is used, a large quantity of water is applied to the recording paper as printing is performed.

Disadvantageously, due to the moisture contained in the ink, the recording paper loses the inherent stiffness or is subjected to deformation such as curl or cockle (local irregularities). This causes problems with handling of the recording paper or decreases the quality of the image or character printed on the recording paper.

In order to address the above problem, it has heretofore been proposed to correct the curl of the recording paper by a curl correcting mechanism provided on the downstream side of the conveying direction, after printing has been performed with respect to the recording paper (for example, refer to JP-A No. 10-181979) However, in JP-A No. 10-181979, since the curl is corrected by passing the recording paper between a conveyor belt and a roller, there is a likelihood that when a printed surface is contacted before the ink is dried, the ink is offset to the roller and thus an image formed on the recording paper is blurred by the ink thus offset.

Further, a so-called duplex printing process is sometimes performed in which recording paper printed on one side is inverted in a paper inverting device and printed on the other side (for example, refer to JP-A No. 2003-128319). When performing a duplex printing process, recording paper is first printed on one side, and then the paper subjected to deformation such as curl or cockle is printed on the other side so that the gap between the inkjet recording head and the recording paper varies. Thus, the timing with which ink droplets land on the paper changes so that the image quality is decreased, and when the change in the shape is great then the paper can contact with the inkjet recording head. In the worst case, a paper jam is caused. Consequently, there is likelihood that trouble such as deterioration of the ejection performance of the inkjet recording head or inability to eject ink is caused.

SUMMARY OF THE INVENTION

In view of the above problems, the present invention intends to suppress occurrence of curl or cockle which tends to be caused when an image is recorded on recording paper.

According to a first aspect of the present invention, there is provided an image recording apparatus wherein an image is recorded on a recording medium based on image information by ejecting liquid droplets from a liquid droplet ejecting head, comprising: a liquid droplet ejecting head having an ejection region substantially corresponding to a width of the recording medium; a conveyor unit that conveys the recording medium to the ejection region of the liquid droplet ejecting head with the recording medium attracted and attached thereto and supported thereon; a paper discharge section to which the recording medium is fed from the conveyor unit; and a plurality of attracting and supporting sub-units, within an attracting and supporting unit, that are vertically moved with the recording medium, which is delivered thereto from the conveyor unit, attracted and attached thereto and supported thereon, thereby conveying the recording medium to a subsequent step.

According to a second aspect of the present invention, there is provided an image recording apparatus wherein an image is recorded on a recording medium based on image information by ejecting liquid droplets from a liquid droplet ejecting head, comprising: a liquid droplet ejecting head having an ejection region substantially corresponding to a width of a recording medium; a conveyor unit that conveys the recording medium to the ejection region of the liquid droplet ejecting head with the recording medium attracted and attached thereto and supported thereon; a paper discharge section to which the recording medium is fed from the conveyor unit; and a plurality of attracting and supporting sub-units, within an attracting an supporting unit, that are vertically moved with the recording medium, which is delivered thereto from the conveyor unit, attracted and attached thereto and supported thereon, thereby conveying the recording medium to a subsequent step; wherein the attracting and supporting unit comprises: a movement mechanism that is circulated substantially vertically; flexible attracting and supporting members that are mounted to the movement mechanism with a predetermined spacing and attract and support the recording medium; a support member that is formed substantially vertically with step portions for supporting free ends of the attracting and supporting members, the support member comprising a belt that is circulated substantially vertically in response to movement of the movement mechanism and the step portions being movably mounted to the belt and supporting the free ends of the attracting and supporting members; an attracting sheet connected to a voltage applying mechanism, and wherein the attracting sheet has a generation of an attracting and supporting force enabled and disabled by rendering on and off a voltage supply from the voltage applying mechanism.

According to a third aspect of the present invention, there is provided an image recording apparatus wherein an image is recorded on a recording medium based on image information by ejecting liquid droplets from a liquid droplet ejecting head, comprising: a liquid droplet ejecting head having an ejection region corresponding substantially to a width of the recording medium; a conveyor unit that conveys the recording medium to the ejection region of the liquid droplet ejecting head with the recording medium attracted and attached thereto and supported thereon; a paper discharge section to which the recording medium is fed from the conveyor unit; and a plurality of attracting and supporting sub-units, within an attracting and supporting unit, that are vertically moved with the recording medium, which is delivered thereto from the conveyor unit, attracted and attached thereto and supported thereon, thereby conveying the recording medium to a subsequent step; wherein the attracting and supporting unit comprises: a movement mechanism that is circulated substantially vertically; foldable attracting and supporting trays that attract and support the recording medium, the foldable attracting and supporting trays being rotatably mounted to the movement mechanism with a predetermined spacing;support pedestals that support mounted portions of the attracting and supporting trays, the support pedestal being provided on the movement mechanism; backing plates that prevents the attracting and supporting tray from being folded, the backing plate being provided on foldable portion of the attracting and supporting trays; and an attracting sheet connected to a voltage applying mechanism, and wherein the attracting sheet has the generation of an attracting and supporting force enabled and disabled by rendering on and off a voltage supply from the voltage applying mechanism.

Other aspects, features and advantages of the present invention will become apparent from the following description taken in conjunction with the accompanying drawings.

BRIEF DESCRIPTION OF THE DRAWINGS

Preferred embodiments of the present invention will be described in detail based on the following figures, in which.

DETAILED DESCRIPTION OF THE INVENTION

An image recording apparatus according to a first embodiment of the present invention will now be described with reference to the drawings.

Figure 1:
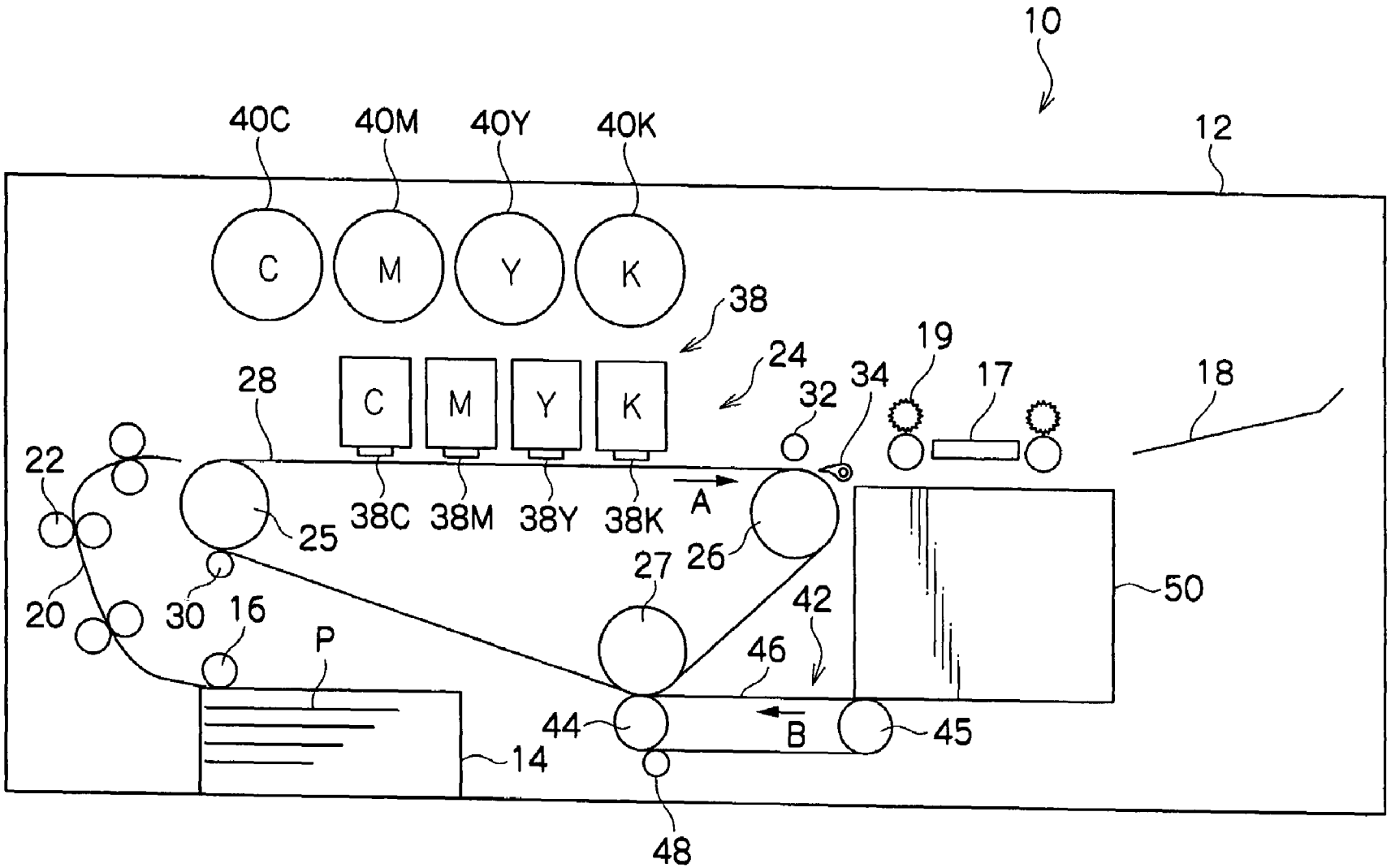
FIG. 1 is a schematic diagrammatic view showing an image recording apparatus according to a first embodiment of the present invention.

As shown in FIG. 1, the image recording apparatus (inkjet recording apparatus) 10 includes an image recording apparatus body 12. At a bottom portion of the image recording apparatus body 12 is provided a paper feed tray 14 in which paper sheets P are stored in a bundle-like stack.

Above a fore end portion of the paper feed tray 14 is mounted a pick-up roller 16 which is accommodated in the paper feed tray 14 and disposed in pressure contact with a fore end portion of the top surface of paper P, which is biased upward by an unillustrated loading plate, thereby taking out a sheet of the paper P from the paper feed tray 14.

Further, above the paper feed tray 14, a conveying path 20 is provided which extends in a curved manner from a vicinity of the fore end portion of the paper feed tray 14 (the pressure contact portion between the pick-up roller 16 and the paper P) to a conveyor device 24.

The conveying path 20 is provided with a plurality of conveying roller pairs 22 by which the paper P, taken out from the paper feed tray by the pick-up roller 16, is fed along the conveying path 20 into the conveyor device 24.

The conveyor device 24 is provided approximately at the center of the image recording apparatus body 12 and which includes two rollers 25 and 26 disposed at both sides of a recording head unit 38, a roller 27 disposed below the rollers 25 and 26, and an endless belt 28 entrained about the rollers 25, 26, and 27. In this structure, the roller 25 disposed at an upstream side as viewed in the conveying direction of the paper (at a left hand side as viewed in the drawing) is rotationally driven by an unillustrated driving motor so that the conveyor belt 28 is rotationally moved in a predetermined direction (direction indicated by an arrow A).

A charging roller 30 is provided near the roller 25, and the conveyor belt 28 is charged by the charging roller 30. Thus, the paper P is electrostatically attracted and attached to the conveyor belt 28, and conveyed in the direction of the arrow A as the conveyor belt 28 is rotated.

Further, a charge-removing mechanism 32 is provided near the roller 26. The paper P is conveyed, to the position where the charge-removing mechanism is provided, in response to the rotational movement of the conveyor belt 28, and charge-removed there so as to be detached from the conveyor belt 28. Then, the paper P is guided by a detaching member 34 provided at a downstream side of the roller 26 as viewed in the conveying direction, and conveyed to a temporary stack tray 50 or a catch tray 18 provided at a downstream side of the conveyor device as viewed in the conveying direction. The structure of the temporary stack tray 50 will be described hereinafter.

Below the stack tray 50 is provided a paper delivery device 42 which includes a roller 44 provided adjacent to roller 27 of the conveyor device 24, a roller 45 provided substantially in parallel with the roller 44, and an endless belt 46 entrained about the roller 44 and 45. An unillustrated driving motor is coupled to the roller 44, and when the roller 44 is rotated in response to the rotational driving of the driving motor, the conveyor belt 46 is rotationally moved in a predetermine direction (direction indicate by an arrow B)

In the vicinity of the roller 44, there is provided a charging roller 48 which causes the conveyor belt 46 to be charged. Consequently, the paper P is electrostatically attracted and attached to the conveyor belt, and conveyed in the direction of the arrow B as the conveyor belt 46 is rotated.

On the other hand, above the conveyor belt 28 is located the recording head unit 38 which is structured such that it is vertically moved by being driven by an unillustrated elevating mechanism. The recording head unit 38 includes recording heads 38C, 38M, 38Y, and 38K which are provided along the rotating direction of the conveyor belt 28 in that order as viewed from an upstream side of the rotating direction of the conveyor belt 28 (in the direction in which the paper P is conveyed). These recording heads 38C, 38M, 38Y, and 38K are designed to eject liquid droplets of four colors such as cyan (C), yellow (Y), magenta (M), and black (K) respectively onto the paper P conveyed by the conveyor belt 28 with predetermined respective timings, thereby forming a color image.

In the image recording apparatus body 12, there are provided ink tanks 40C, 40M, 40Y, and 40K in which liquid droplets of the four colors such as cyan, magenta, yellow and black are stored respectively and from which the inks of the respective colors are supplied to the recording heads 38C-38K through unillustrated pipes, respectively.

Description will now be made of the printing operation (color image recording operation) performed by the image recording apparatus 10 of this embodiment which is structured as described above.

In the image recording apparatus 10, when the printing operation is started in response to a printing job inputted thereto, the roller 25, connected to an unillustrated driving motor, is rotated so that the conveyor belt 28 is rotated in the direction of the arrow A and at the same time the pick-up roller 16 is rotated on the paper feed tray 14 side. In this way, a sheet of the uppermost paper P is taken out from the paper bundle accommodated in the paper feed tray 14 and fed out to the conveyor path 20. The paper P thus taken out is conveyed to the most upstream portion of the conveyor belt 28 by the plural conveyor roller pairs 22 and fed onto the conveyor belt 28.

The recording heads 38C-38K of the recording head unit 38 actuate in synchronism with the conveyance of the paper P which is carried out in response to the rotation of the conveyor belt 28 and eject the inks supplied from the ink tanks 40C-40K, via nozzles with the predetermined timings.

Ink droplets of the respective colors such as cyan, magenta, yellow and black which are ejected from the recording heads 38C-38K are caused to successively land on a surface of the paper P conveyed by the conveyor belt 28, and images of the respective colors formed by these ink droplets are superposed so that a color image is recorded.

Further, in the case of a so-called simplex printing operation, in which an image is formed only on a one-side surface of a paper P, the paper P is conveyed on the conveyor belt 28 and discharged onto a catch tray 18, while being corrected in terms of floating-up of the fore end, by a spur roller 19 provided on a conveyor path 17 between the conveyor device 24 and the catch tray 18.

On the other hand, in the case of a so-called duplex printing operation, in which images are formed on the both surfaces of a paper P, the paper P having an image on one-side surface thereof is conveyed by the conveyor belt 28 and fed into the temporary stack tray 50. Subsequently, the paper P is conveyed downwardly by the temporary stack tray 50, and conveyed to the paper delivery device 42.

The paper P conveyed to the paper delivery device 42 is conveyed on the conveyor belt 46 and fed into a nip portion between the roller 27 and a roller 44. Subsequently, the paper P is electrostatically attracted and attached to the conveyor belt 28 and conveyed below the recording head unit 38 in a state in which it is inverted upside-down. In this way, an image is formed on an opposite-side surface of the paper P, and consequently the images are formed on both surfaces of the paper P.

Next, the structure of the temporary stack tray 50 will be explained.

Figure 2:
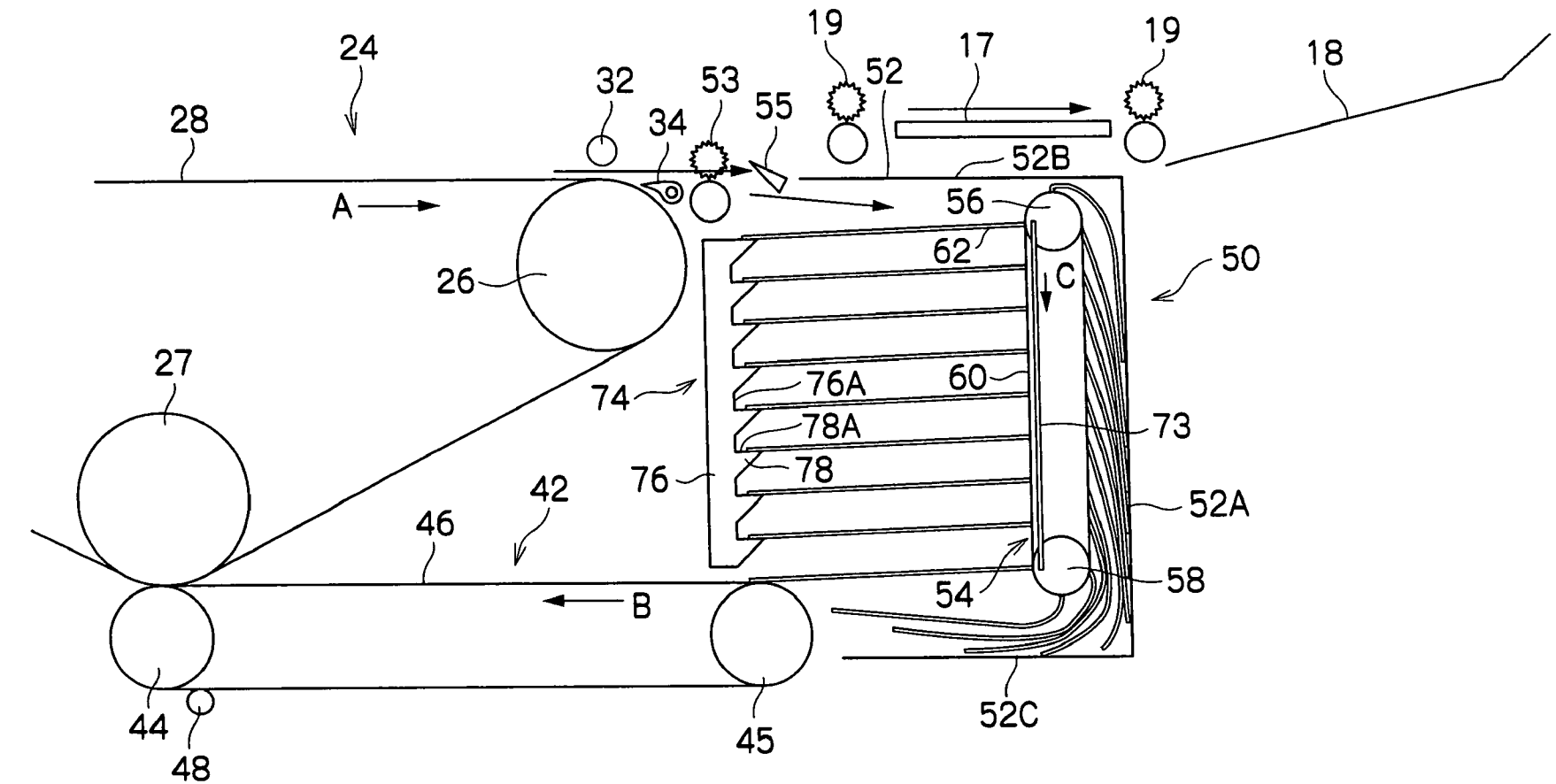
FIG. 2 is a schematic diagrammatic view showing a temporary stack tray mounted in the image recording apparatus according to the first embodiment of the present invention.

As shown in FIG. 2, the temporary stack tray 50 includes a housing 52 formed in an approximately box-like shape which is open in one direction, and a tray conveyor device 54 is provided in the vicinity of a side wall 52A opposite to the open side of the housing 52.

The tray conveyor device 54 includes rollers 56 and 58 which are vertically disposed, and an endless belt 60 entrained about the rollers 56 and 58. The roller 56 is coupled to an unillustrated drive motor, and rotated by the rotational driving of the drive motor so that the belt 60 is rotated in a predetermined direction (the direction indicated by an arrow C).

Mounted to the belt 60 are a plurality of trays 62 which are spaced vertically (along the moving direction of the belt 60) at a predetermined distance so as to be vertically moved in response to the rotational movement of the belt 60, whereby plural sheets of the paper P are simultaneously conveyed by means of the trays 62.

The trays 62 are formed in an approximately rectangular shape from a flexible plastic film and structured so as to be easily flexible. Further, as shown in FIG. 3A, each of the trays 62 is fixed at one end thereof to the belt 60 with an adhesive 61 in a manner to be substantially perpendicular to the belt 60 and become planar when no external force is imparted thereto.

Thus, as shown in FIG. 2, when the one end of the tray 62 (the portion of the tray 62 which is attached to the belt 60) is disposed in opposing relationship to the side wall 52A and side walls 52B and 52C perpendicular to the side wall 52A of the housing 52, the tray 62 is held between the tray conveyor device 54 and the side walls, 52A, 52B and 52C are in a flexed state along the side walls 52A, 52B and 52C.

On the other hand, when the tray 62 is located in a region in which the tray 62 conveys the paper P, i.e., when the free end of the tray 62 is positioned at the open side of the housing 52, no external force is applied to the tray 62, and thus the tray 62 becomes planar and holds the paper P in a state in which the paper P is attracted and attached thereto.

As shown in FIG. 2, a tray support column 74 is provided at an upstream side in the conveying direction of the tray conveyor device 54. The tray support column 74 includes a vertically extending elongate column portion 76 and has a side wall 76A opposite to the tray conveyor device 54, the side wall 76 being provided with a plurality of support step portions 78 which are vertically spaced apart from each other with the same distance as the trays 62 mounted to the belt 60. Each of the support step portions 78 is made to be substantially triangular in cross section, and the free end of a respective one of the trays 62 is supported on an upper surface 78A of a corresponding one of the support step portions 78.

Figure 3B:
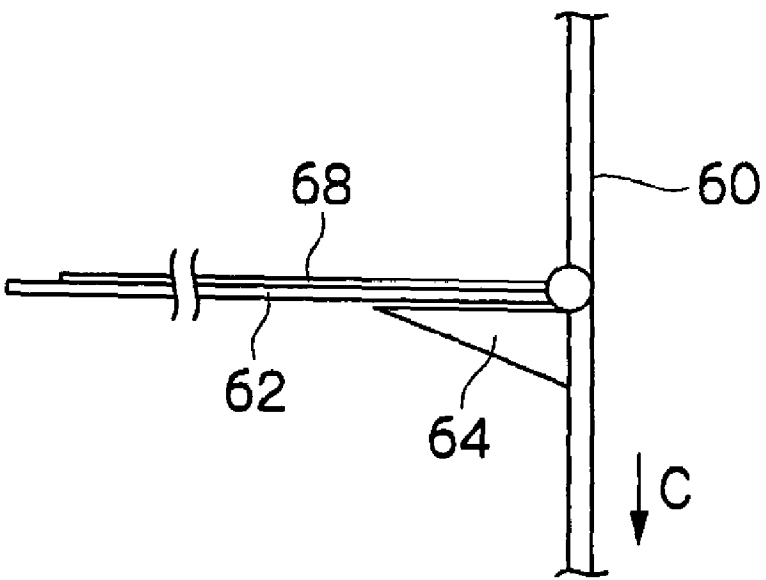
FIGS. 3A and 3B are explanatory views illustrating how a tray to constitute the temporary stack tray according to the first embodiment of the present invention is mounted.
Figure 3A:
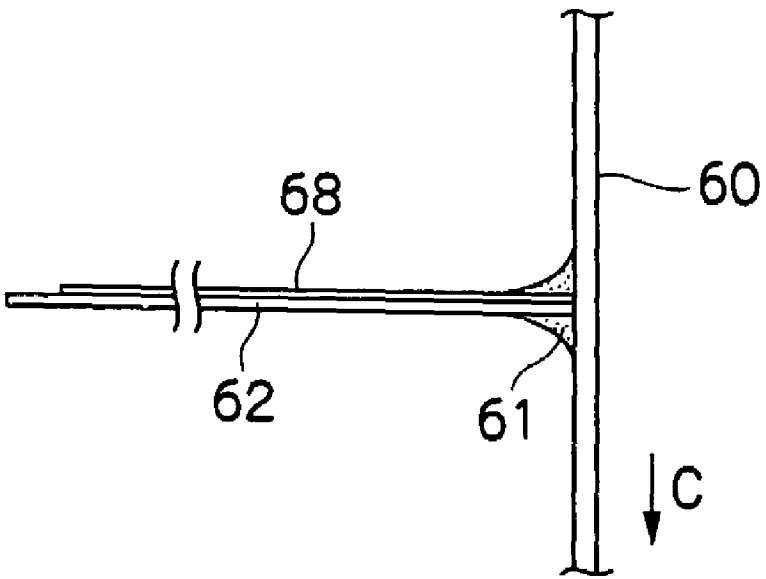

Meanwhile, although in this embodiment, one end of each tray 62 is fixed to the belt 60 in a state that is perpendicular to the belt 60 as shown in FIG. 3A, it is also possible that one end of each tray 62 may be rotatably attached to the belt 60 and the free end thereof may be supported by a support brace 64 provided on the belt 60 as shown in FIG. 3B. Thus, the tray 62 becomes liable to be flexed in a direction opposite to the side where the support brace 64 is provided, so that even though the tray 62 is rotationally moved while being held between the side walls 52A, 52B and 52C and the tray conveyor device 54, a load imparted to the tray conveyor device 54 is not increased. Further, since the trays 62 are flexed through a large angle, no space in which the trays 62 are displaced is required.

Figure 4:
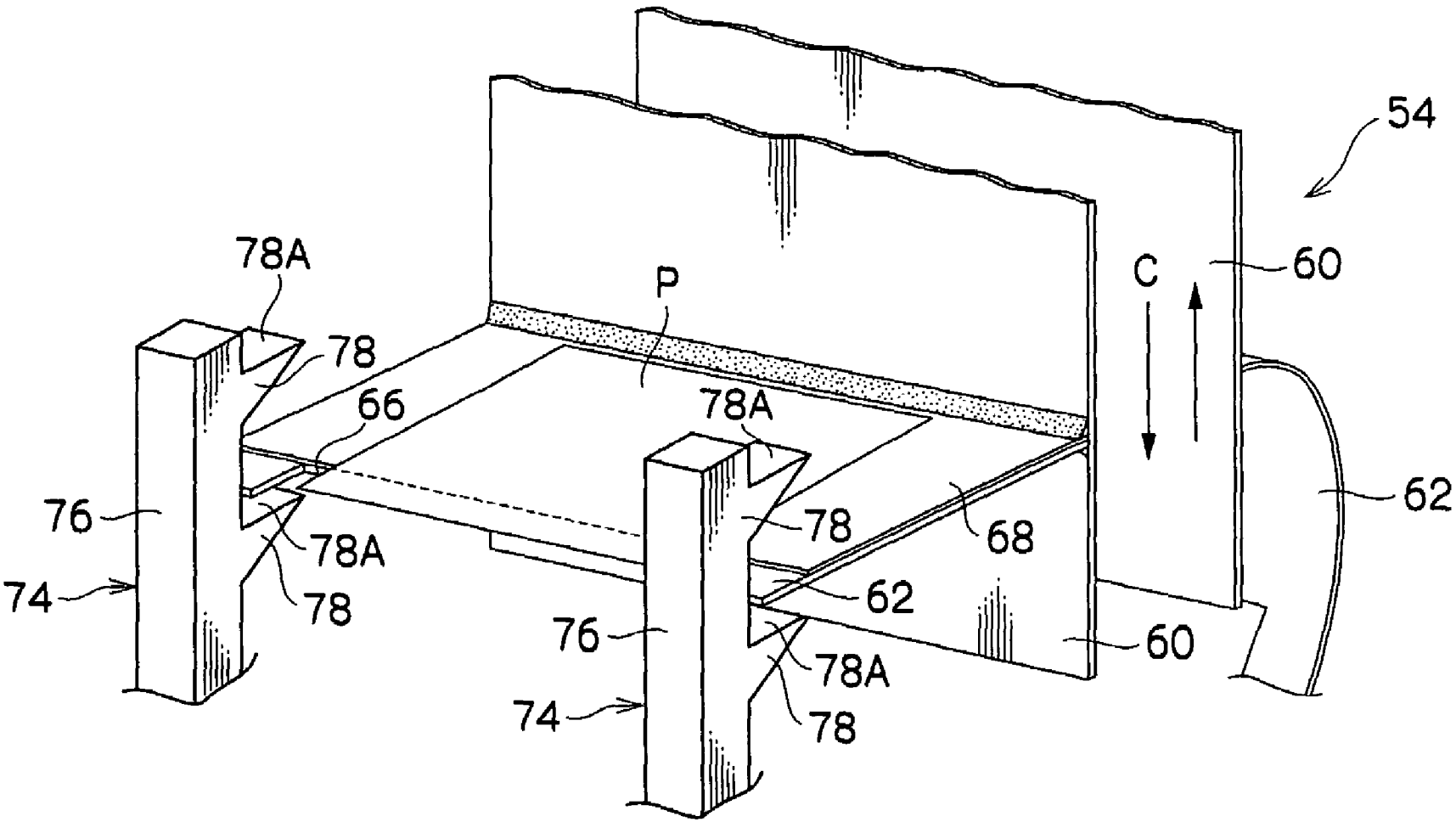
FIG. 4 is a fragmentary perspective view showing the structure of the temporary stack tray according to the first embodiment of the present invention.

Furthermore, as shown in FIG. 4, the free end portion of each tray 62 is formed with a notch 66 which is approximately U-shaped as seen in a plan view. When a paper P is placed on the tray 62, an end portion of the paper P protrudes out from the notch 66.

Thus, as shown in FIG. 2, when the paper P on the tray 62 is placed in contact with the belt 60 of the paper delivery device 42 because of the tray 62 being moved downward in response to a rotational movement of the belt 60, the portion of the paper P which protrudes from the notch 66 (see FIG. 4) is brought into contact with the belt 60 and electrostatically attracted and attached to the belt 46 so that the paper P is smoothly delivered from the tray 62 onto the belt 64.

Figure 5A:
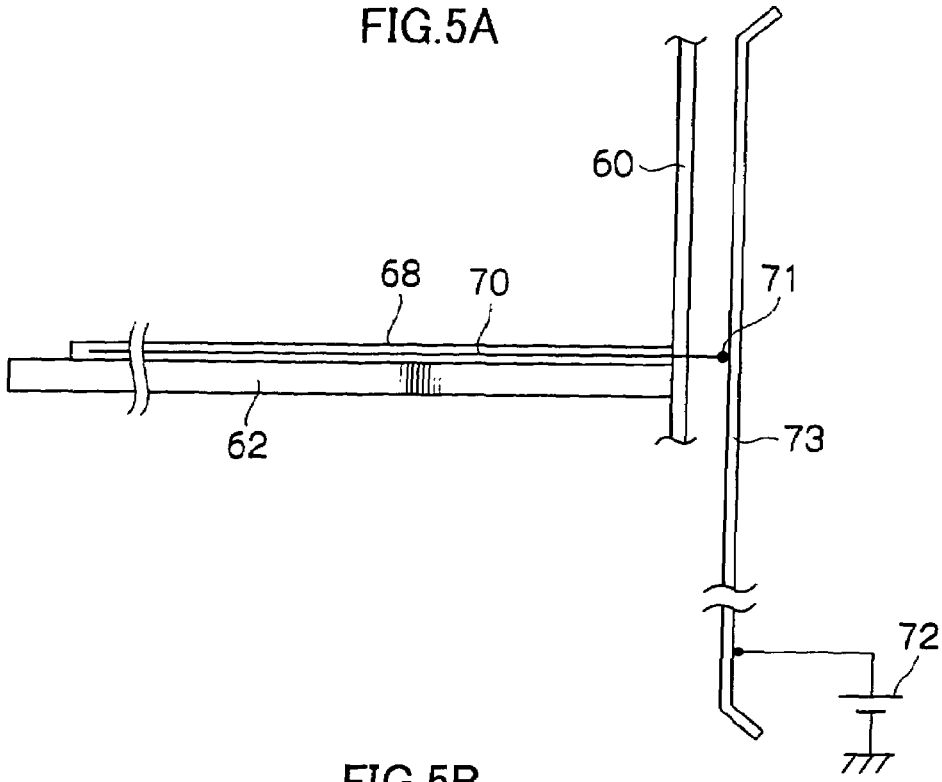
FIGS. 5A and 5B are simplified views showing the structure of a tray to constitute the temporary stack tray according to the first embodiment of the present invention.
Figure 5B:
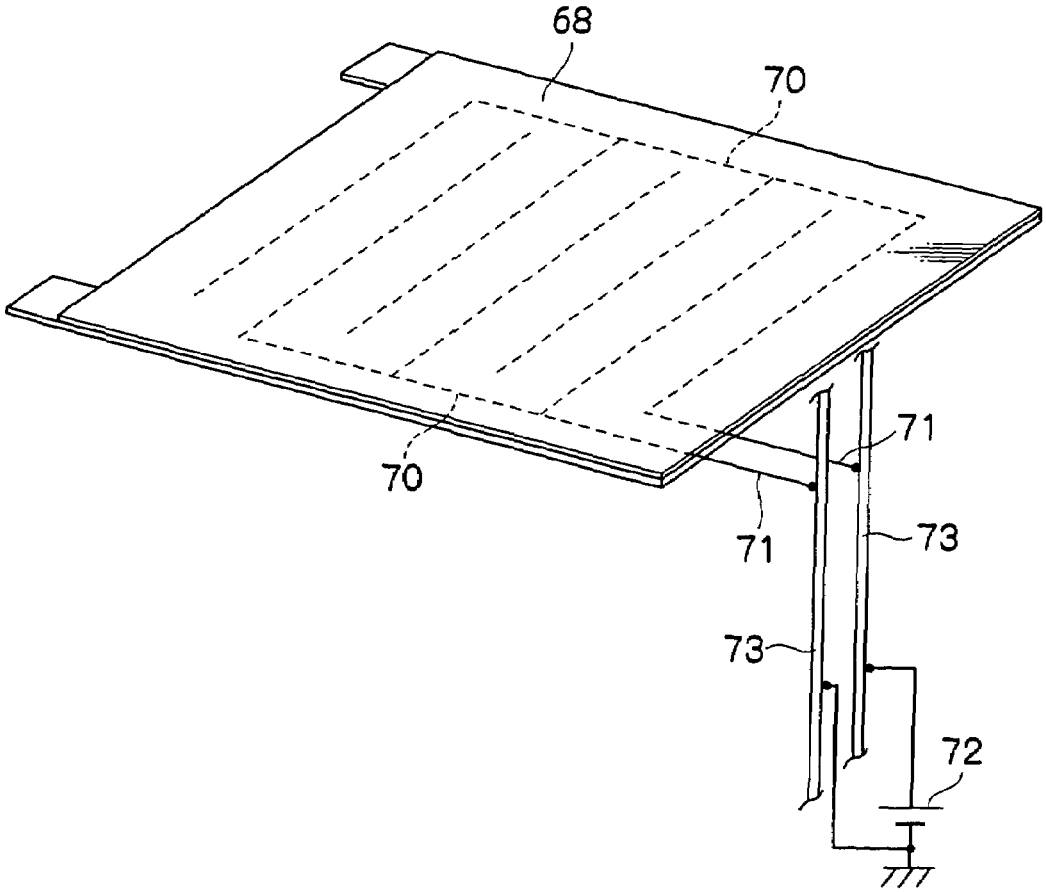

Further, as shown in FIG. 5A, a paper attracting sheet 68 is adhered to the tray 62. As shown in FIG. 5B, the paper attracting sheet 68 is formed from a plastic film and includes electrodes 70 provided therein. The electrodes 70 is connected to electric feeder members 71 which are adapted to contact electric feeder rails provided along the belt 60 at opposite widthwise ends of the belt 60 so that a voltage is applied to the electrodes 70. More specifically, it is arranged that the electric feeder members 71 are placed in contact with the electric feeder rails 73 at the same time that the tray 62 becomes planar because of the belt 60 being rotationally moved, and that the electric feeder members 71 are placed out of contact with the electric feeder rails 73 immediately before the paper P is brought into contact with the belt 46.

Thus, when the free end of the tray 62 is supported on the support step portion 78 and thus the tray 62 becomes planar, the paper attracting sheet 68 is charged and produces an electrostatic attraction force which in turn causes the paper P to be electrostatically attracted and attached to the paper attracting sheet 68. Further, immediately before the paper P is delivered from the tray 62 to the belt 46, the power supply to the paper attracting sheet 68 is interrupted, and thereupon, the electrostatic attraction force of the paper attracting sheet 68 is released. Consequently, the paper P is smoothly delivered from the tray 62 onto the belt 46.

Although in this embodiment, a structure has been adopted in which the paper attracting sheet 68 provided with the electrodes 70 is adhered to the tray 62 and a paper is attracted and attached to the paper attracting sheet 68, it is also possible that a structure may be adopted in which electrodes are embedded directly in the tray 62 such that the tray 62 per se produces an electrostatic attraction force.

Description will now be made of a conveying path for conveying a paper P during a duplex printing operation. The paper conveyed by rotational movement of the conveyor belt 28 of the conveyor device 24 is corrected in terms of floating-up of the fore end by a spur roller 53 provided at open side of the housing 52 as shown in FIG. 2, and fed into the uppermost tray 62 of the temporary stack tray 50 while being guided by a guide member 55.

Figure 6A:
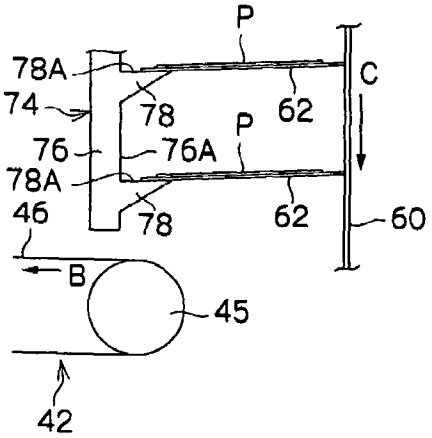
FIGS. 6A to 6D are explanatory views illustrating how paper is conveyed by the temporary stack tray according to the fist embodiment of the present invention.
Figure 6B:
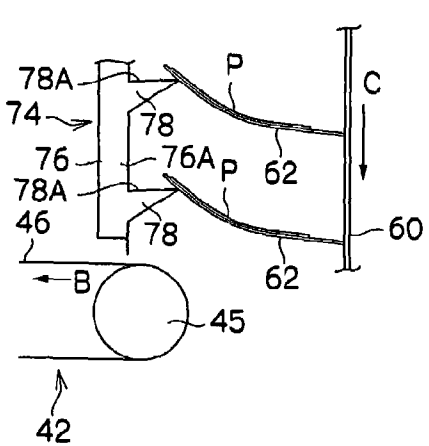

Further, as shown in FIGS. 6A and 6B, as the belt 60 is rotationally moved in the direction of an arrow C, the free end of the tray 62 attached at the other end to the belt 60 is moved in the direction of the arrow C while being slipped down the support step portion 78.

Figure 6C:
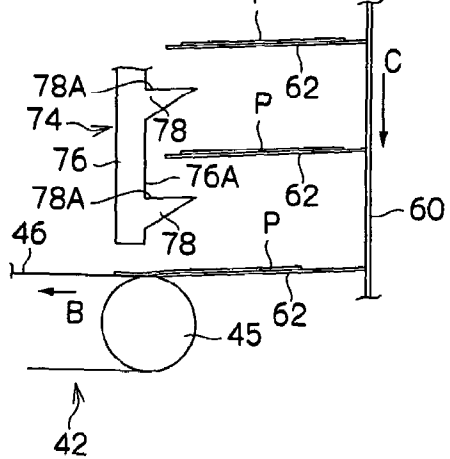
Figure 6D:
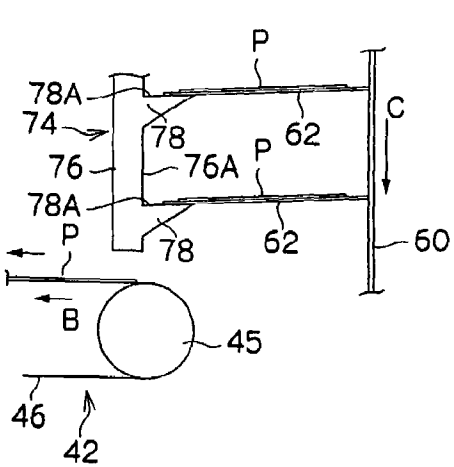

As shown in FIG. 6C, as the tray 62 is further moved in the direction of the arrow C beyond that one of the support step portions 78 which is provided at the lowermost position of a support column, the paper P which protrudes from the notch 66 (see FIG. 4) formed in the free end portion of the tray 62 is brought into contact with the belt 46 of the paper delivery device 42 so as to be delivered to the paper delivery device 42 as shown in FIG. 6D. Thus, the paper P is electrostatically attracted and attached to the conveyor belt 46 and conveyed to the nip portion between the roller 44 and the roller 27. Thereupon, the paper P is removed from the conveyor belt 46 and now electrostatically attracted and attached to the conveyor belt 28.

At this point, the amount of charge at the conveyor belt 28 of the conveyor device 24 is made to be larger than the amount of charge at the conveyor belt 46 of the paper delivery device 42. Consequently, the electrostatic attraction force of the conveyor belt 28 becomes greater than that of the conveyor belt 46, and thus the paper P is smoothly delivered from the conveyor belt 46 to the conveyor belt 28.

Meanwhile, although in this embodiment, a structure has been adopted in which the roller 44 of the paper delivery device is disposed in contact with the roller 27 of the conveyor device 24, it is also possible that the roller 44 may be provided at a position that is out of contact with and slightly spaced apart from the roller 27. In this case, it is also possible that for example, a charge removing mechanism may be provided in the vicinity of the roller 44, thereby causing the paper P to be charge-removed and removed from the conveyor belt 46, and alternatively that the paper P may be removed from the conveyor belt 46 due to its own inherent elasticity and electrostatically attracted and attached to the conveyor belt 28 of the conveyor device 24.

Further, although a structure has been adopted in which the roller 44 is rotated by the drive motor connected thereto, thereby permitting the conveyor belt 46 to be rotationally moved, it is also possible that because of the roller 27 of the conveyor device 24 being disposed in contact with the roller 44, the roller 44 may be rotated following rotation of the roller 27 so that no difference occurs between the conveying speed of the conveyor belt 46 and that of the conveyor belt 28, thereby permitting the paper P to be smoothly conveyed from the conveyor belt 46 onto the conveyor belt 28.

Description will next be made of the operation of the first embodiment of the present invention.

A sheet of paper P on which an image has been formed with ink droplets ejected from the recording heads 38C-38K is fed from the conveyor device 24 to the temporary stack tray 50 and conveyed to the paper delivery device 42 located below the image recording apparatus body 12 while being held by the plural trays 62 in a state attracted and attached thereto.

By providing the plural trays 62 which hold the paper P, having an image formed thereon, in a state attracted and attached thereto and moving the trays 62 downward, it is possible to dry the moisture of the paper P and convey the paper P to the paper delivery device 42 without decreasing productivity.

Further, when an image is formed on the reverse side of the paper P (reverse side printing), deformation (curl or cockle) which tends to occur on the paper P is suppressed so that there is no possibility that the gap between the recording head 38 and the paper P changes from one location to another. Thus, it is possible to prevent a shift of the timing with which ink droplets land on the paper P. Further, when an image is formed on the reverse side of the paper P, it is also possible to prevent occurrence of paper-jams or image distortions.

Furthermore, since plural sheets of the paper P can be held in a vertical direction in the temporary stack tray 50, only a space corresponding to one sheet of the paper P is needed in the conveying direction of the image recording apparatus body 12, and thus there is no demand that the image recording apparatus body 12 be made larger in the conveying direction. Further, since the paper P is electrostatically attracted and attached to the trays 62 on a per-sheet basis, the paper P is conveyed in an isolated manner. Thus, there is no possibility that ink droplets ejected onto a given sheet of paper P are caused to be offset to another sheet of paper P.

Further, by changing the conveying direction of the paper P at the paper delivery device 42 provided below the temporary stack tray 50, the temporary stack tray 50 can be structured such that the paper P is conveyed only vertically. In other words, since there is no need to provide the temporary stack tray 50 with a mechanism for reversing the paper P, the structure of the temporary stack tray 50 does not become complex.

Further, the flexible trays 62 are attached in a predetermined spacing to the vertically rotatable belt 60 with the free ends of the trays 62 supported on the support step portions 78 of the tray support column 74. Thus, the trays 62 can be vertically moved while maintaining a position capable of holding paper P without trailing down. Further, when moved upward no space in which the trays 62 are moved is required since the trays 62 are folded by being engaged with the housing 52 when vertically moved.

Next, description will be made of a temporary stack tray 82 which is mounted in an image recording apparatus 80 according to a second embodiment of the present invention. Meanwhile, description of parts similar to those of the first embodiment will be omitted.

Figure 7:
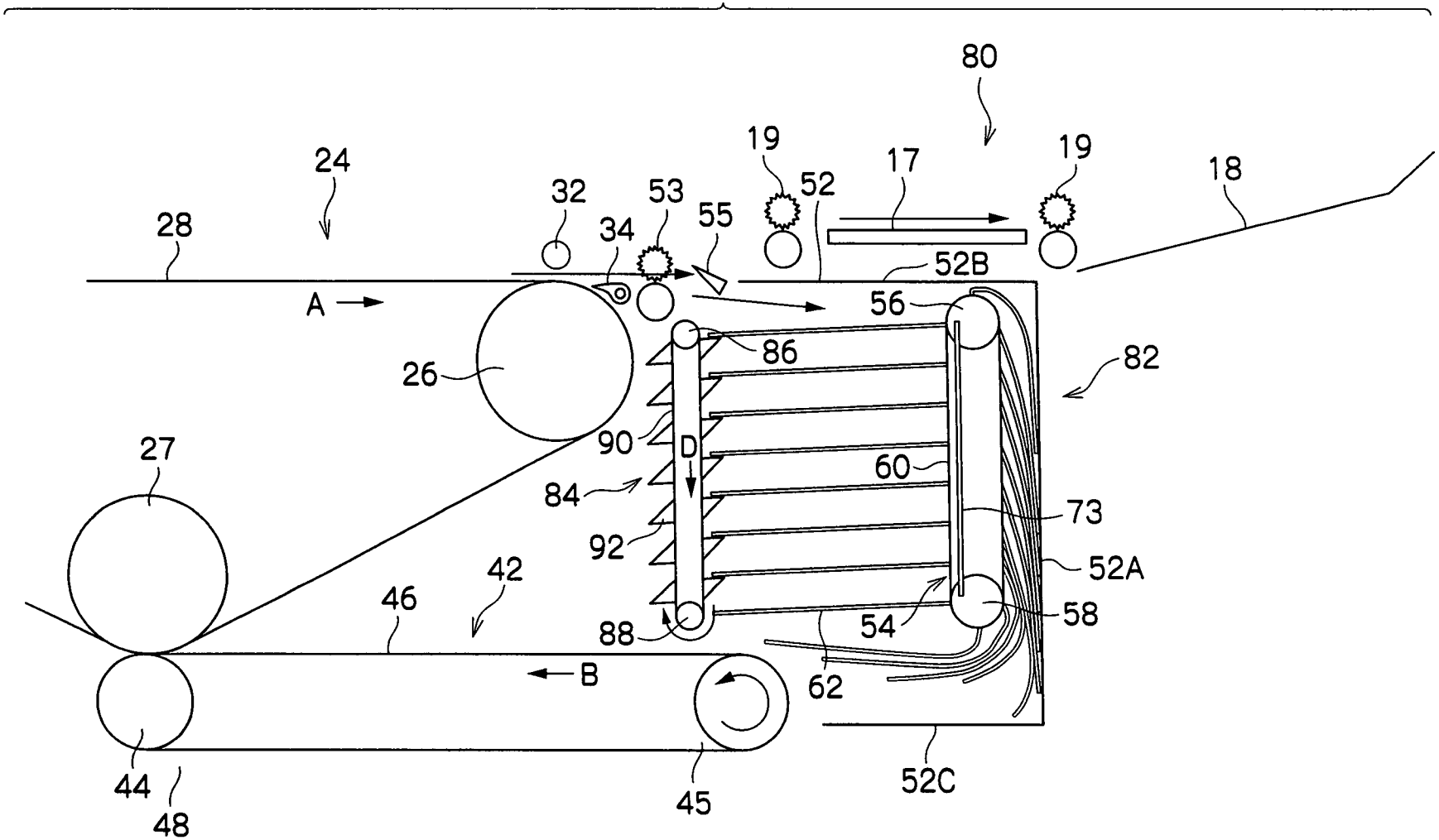
FIG. 7 is a schematic diagrammatic view of a temporary stack tray mounted in an image recording apparatus according to a second embodiment of the present invention.

As shown in FIG. 7, the temporary stack tray 82 includes a tray support member 84 which is provided with vertically spaced two rollers 86 and 88 about which is entrained an endless belt 90. The belt 90 is provided with plural support pedestals 92 which are vertically spaced from each other with the same spacing as that of the trays 62 mounted to the belt 60 of the tray conveyor device 54.

The roller 88 is connected to an unillustrated drive motor and thereby rotated so that the belt 90 is moved in an arrow D direction and concomitantly the support pedestals 92 are moved in the arrow D direction. At this point, the belt 90 is rotationally moved at substantially the same speed as the belt 60 of the tray conveyor device 54, and thus the support pedestals 92, are moved along with the trays 62 while supporting the free ends of the trays 62.

Moving the support pedestals 92 along with the trays 62 as above results in the free end portions of the trays 62 being supported by the support pedestals 92 all the time. Thus, the paper sheets P attracted and attached to and held on the trays 62 are conveyed in a stable state.

Figure 8:
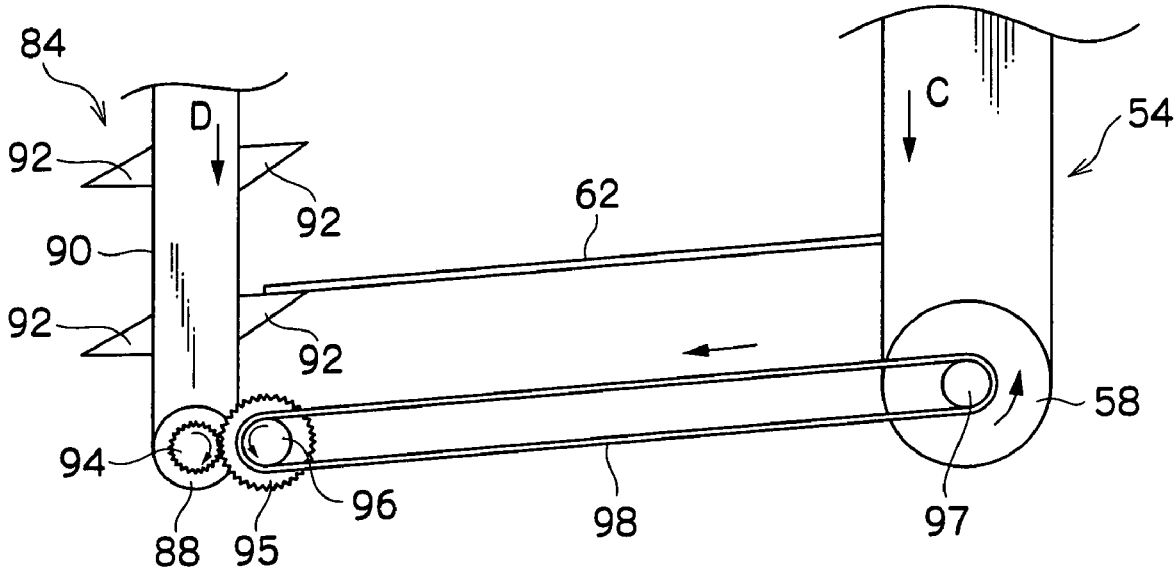
FIG. 8 is a schematic view showing another form of the temporary stack tray mounted in the image recording apparatus according to the second embodiment of the present invention.

Meanwhile, although in this embodiment, a structure has been adopted in which the roller 88 of the tray support member 84 is connected to a drive motor and the belt 90 of the tray support member 84 is rotationally moved at the same speed as the belt 60 of the tray conveyor device 54, it is also possible that an alternative structure may be adopted in which as shown in FIG. 8, a gear 94 is provided on the shaft of the roller 88 and a timing belt 96 is entrained about a pulley 96 mounted to a gear 95 engaged with the gear 94 and a pulley 97 provided on the shaft of the roller 58 so that the roller 88 is rotated in response to rotation of the roller 58. In the above alternative structure, only one drive motor is required to rotationally move both the belt 60 of the tray conveyor device 54 and the belt 90 of the tray support member 84, which leads to a saving of power consumption. Further, the belt 90 can be easily synchronized with the belt 60 in terms of rotational movement, as compared with the case where the belt 90 and the belt 60 are separately rotated.

Description will next be made of a temporary stack tray 152 which is mounted in an image recording apparatus 150 according to a third embodiment of the present invention. Meanwhile, further explanation about parts similar to those of the first embodiment will be omitted.

Figure 9:
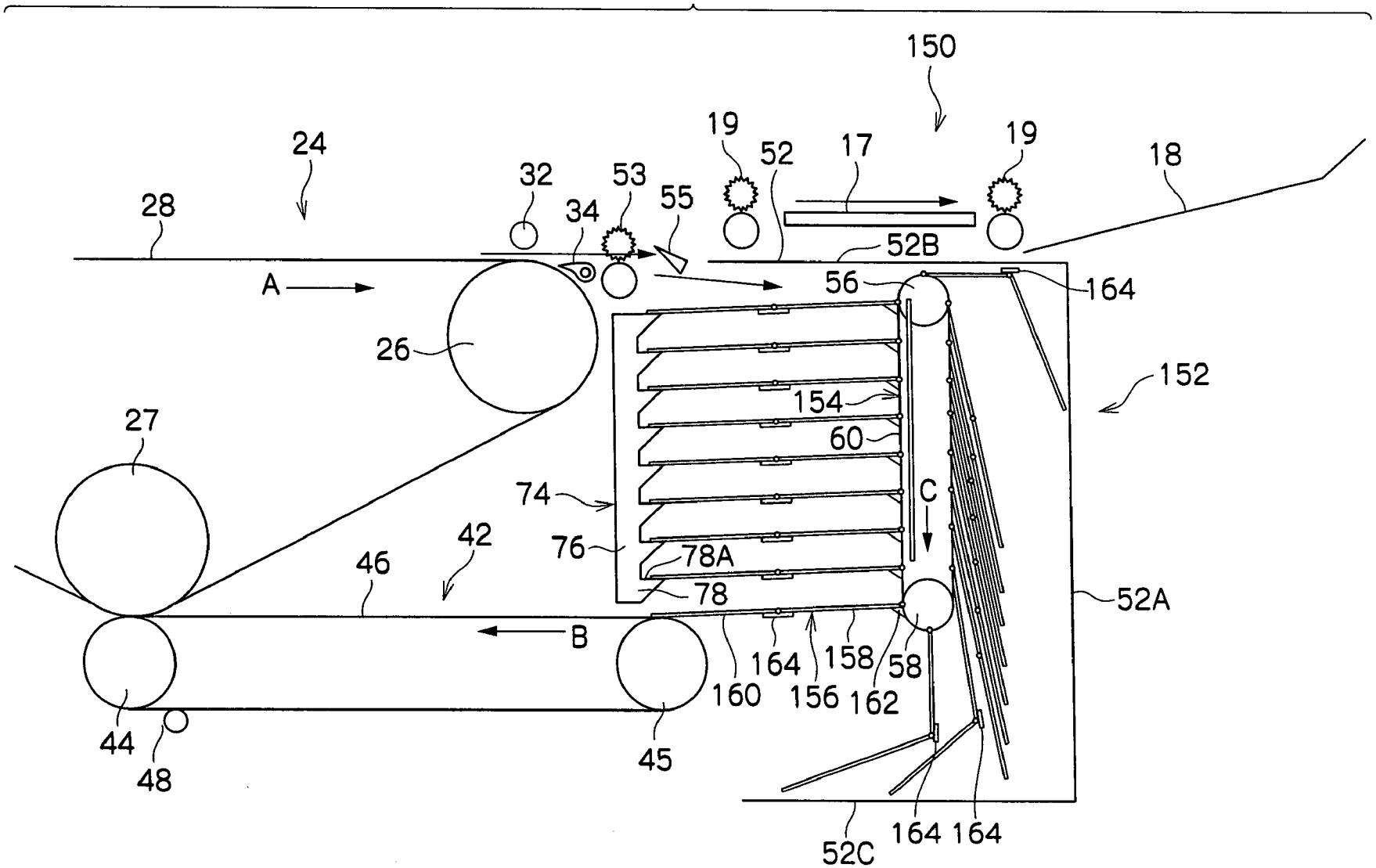
FIG. 9 is a schematic diagrammatic view of a temporary stack tray mounted in an image recording apparatus according to a third embodiment of the present invention.
Figure 10:
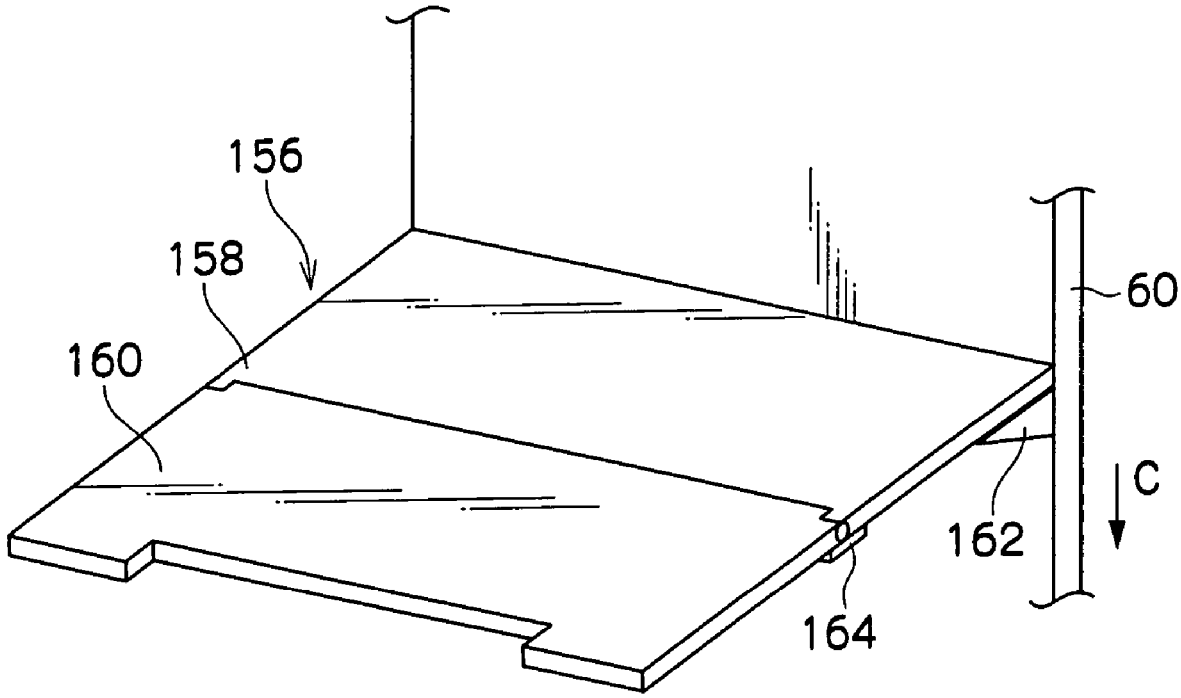
FIG. 10 is a perspective view showing the structure of a tray to constitute the temporary stack tray according to the third embodiment of the present invention.

As shown in FIGS. 9 and 10, a plurality of plastic trays 156, which are vertically spaced from each other with a predetermined spacing, are mounted to a belt 60 of a tray conveyor device 154. The plastic trays 156 include an approximately rectangular plate portion 158 which is rotatably attached at one end to the belt 60. A plate portion 160 is coupled to the other end of the plate portion 158 in a manner that is rotatable with respect to the plate portion 158, and thus the plate portion 158 can be folded with respect to the plate portion 160 and vice versa.

Further, a stopper member 164 is provided in a manner to extend along the reverse surface of the plate portion and across the coupling portion between the plate portion 158 and the plate portion 160. In such a structure, since in a region (left-hand side in the figure) where paper P is attracted and attached thereto and held thereon, the plate portion 160 is supported by the stopper member 164 and thus prevented from rotating downward, the plastic tray 156 becomes planar. Further, the belt 60 is provided with support pedestals 162, and thus when the plate portion 158 is located at the left side of the belt 60, the mounting portion of the plate portion 158 is supported so that the plate portion 158 maintains a horizontal position.

Further, a paper attracting sheet 68 such as shown in FIG. 5B is adhered to the other surface of the plate portions 158 and 160. Thus, paper P fed onto the plastic tray 156 is electrostatically attracted and attached to the plate portions 158 and 160. Meanwhile, the mechanism for charging the paper attracting sheet 68 is not shown since it is similar to that of the first embodiment.

As shown in FIG. 9, when one end (the portion attached to the belt 60) of the plastic tray 156 is placed in opposing relationship to the side walls 52B and 52C, perpendicular to the side wall 52A of the housing 52, through rotational movement of the belt 60, the support pedestal 162 and the stopper member 164 are vertically inverted. For this reason, when the plastic tray 156 is interposed between the tray conveyor device 154 and the side walls 52B and 52C, the plate portion 160 is folded toward the plate portion 158 and thereupon the plate portion 158 is folded toward the belt 60, while when the plastic tray 156 is positioned in opposing relationship to the side wall 52A, the plate portion 158 is folded toward the belt 60.

Thus, when the plastic tray 156 is positioned on the side walls 52A, 52B and 52C side, the radius of rotation of the tray conveyor device 154 can be made small so that the image recording apparatus 150 does not become large-sized.

By using the plate-like plastic tray 156 as above, paper P can be attracted and attached to and held on the plastic tray 156 in close contact with the entire surface of the tray. Further, by making the plate portion 160 foldable with respect to the plate portion 158, it is possible to prevent the image recording apparatus 150 from becoming unnecessarily large-sized.

Meanwhile, although in this embodiment, a structure has been adopted in which the free-end of the plastic tray 156 is supported by the stationary support step portion 78 as in the first embodiment, it is also possible that a structure may be adopted in which the free end of the plastic tray 156 is supported by the tray support member 84 (see FIG. 7) used in the second embodiment in which the support pedestals 92 are movable.

Next, description will be made of a temporary stack tray 172 which is mounted in an image recording apparatus 170 according to a fourth embodiment of the present invention. Meanwhile, description of parts similar to those of the first embodiment will be omitted.

Figure 11:
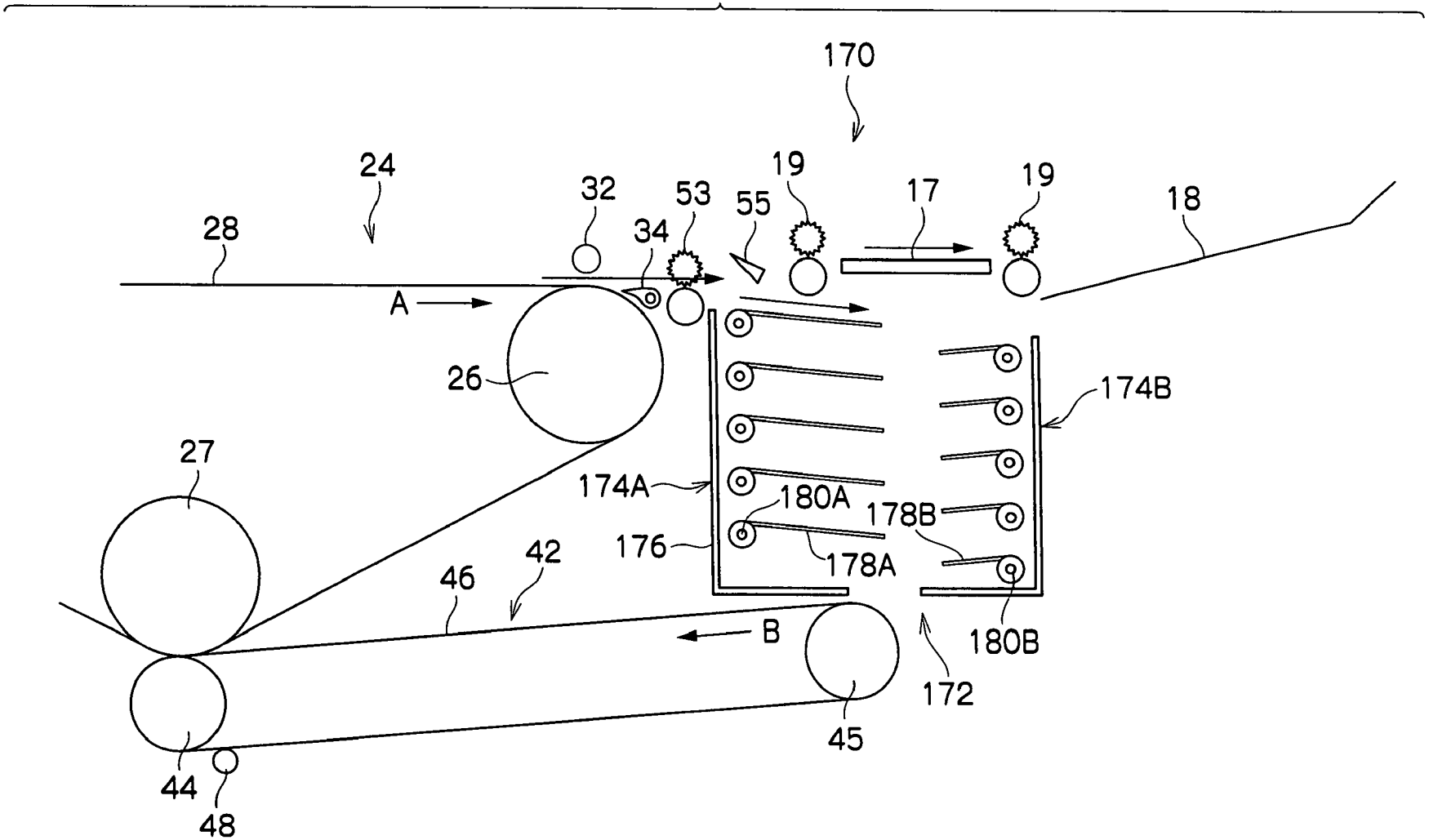
FIG. 11 is a schematic diagrammatic view of a temporary stack tray mounted in an image recording apparatus according to a fourth embodiment of the present invention.

As shown in FIG. 11, the temporary stack tray 172 includes two tray accommodating portions 174A and 174B along the conveying direction. Since the stack tray accommodating portions 174A and 174B have a substantially identical structure, only the stack tray portion 174A will be described by way of example.

The stack tray accommodating portion 174A includes a housing 176 which is open at the downstream side of the conveying direction and approximately U-shaped as viewed from above. On a side wall orthogonal to the conveying direction of the housing 176, there are vertically provided a plurality of (in this embodiment, five) roll-like film trays 178 which are spaced apart from each other with a predetermined distance.

Figure 12:
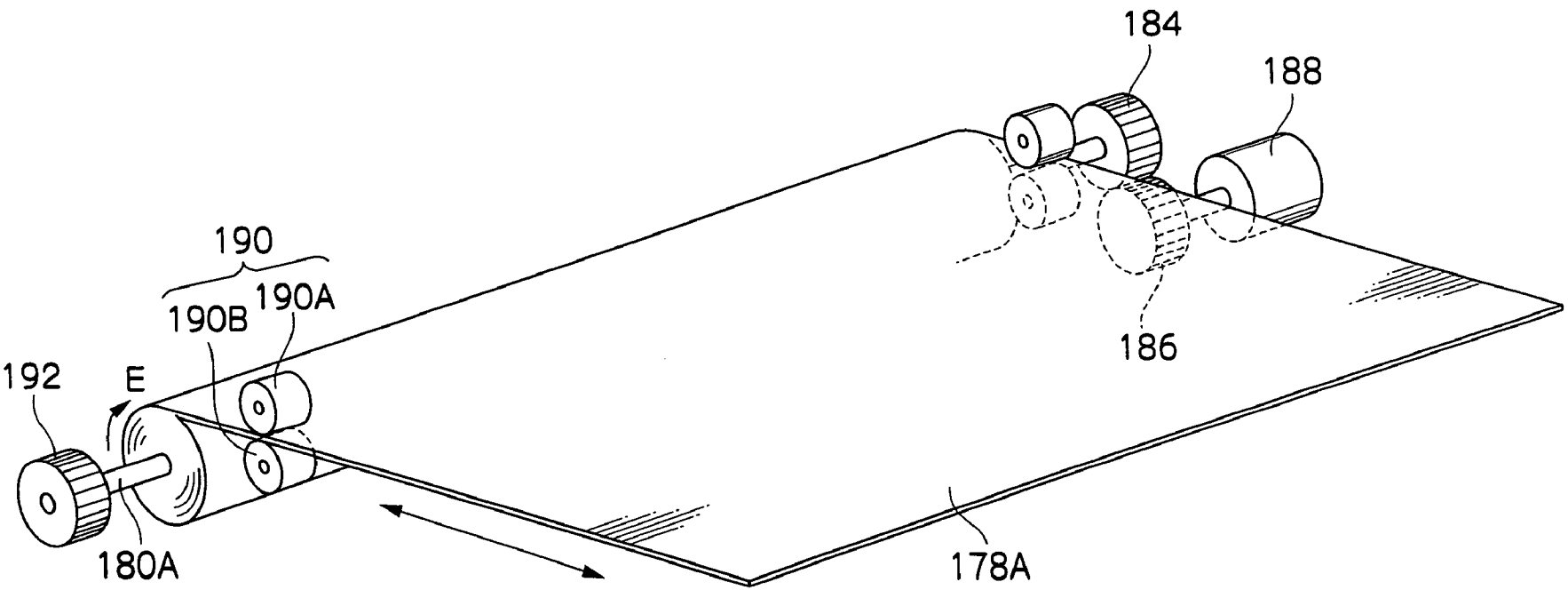
FIG. 12 is a perspective view showing the structure of a tray to form the temporary stack tray according to the fourth embodiment of the present invention.

As shown in FIG. 12, the film tray 178A is taken up on a roller 180A which is rotatably mounted to the side wall of the housing 176. On one end of the roller 180A is mounted a gear 184 which is engaged with a gear 186 connected to a stepping motor 188. Thus, as the gear 186 is rotated by the stepping motor 188, the film tray 178A is unwound from or rewound onto the roller 180A while the unwound length of the film tray 178A is being measured by counting the pulse value of the stepping motor 188

Further, the film tray 178A, which is flexible, becomes a generally downwardly inclined plate-like configuration as shown in FIG. 11 when unwound from the roller 180A by the roller 180A being rotated in a direction opposite to an arrow E. Meanwhile, the film tray 178 may be preferably, but not restrictively, made from a plastics material such as PET, polyimide or the like.

As shown in FIG. 12, guide roller units 190, each comprised of a roller 190A and a roller 190B, are provided in the vicinity of the opposite ends of the roller 180A. The film tray 178A is held between the rollers 190A and 190B of the guide roller units 190 and thereby prevented from meandering.

Figure 13:
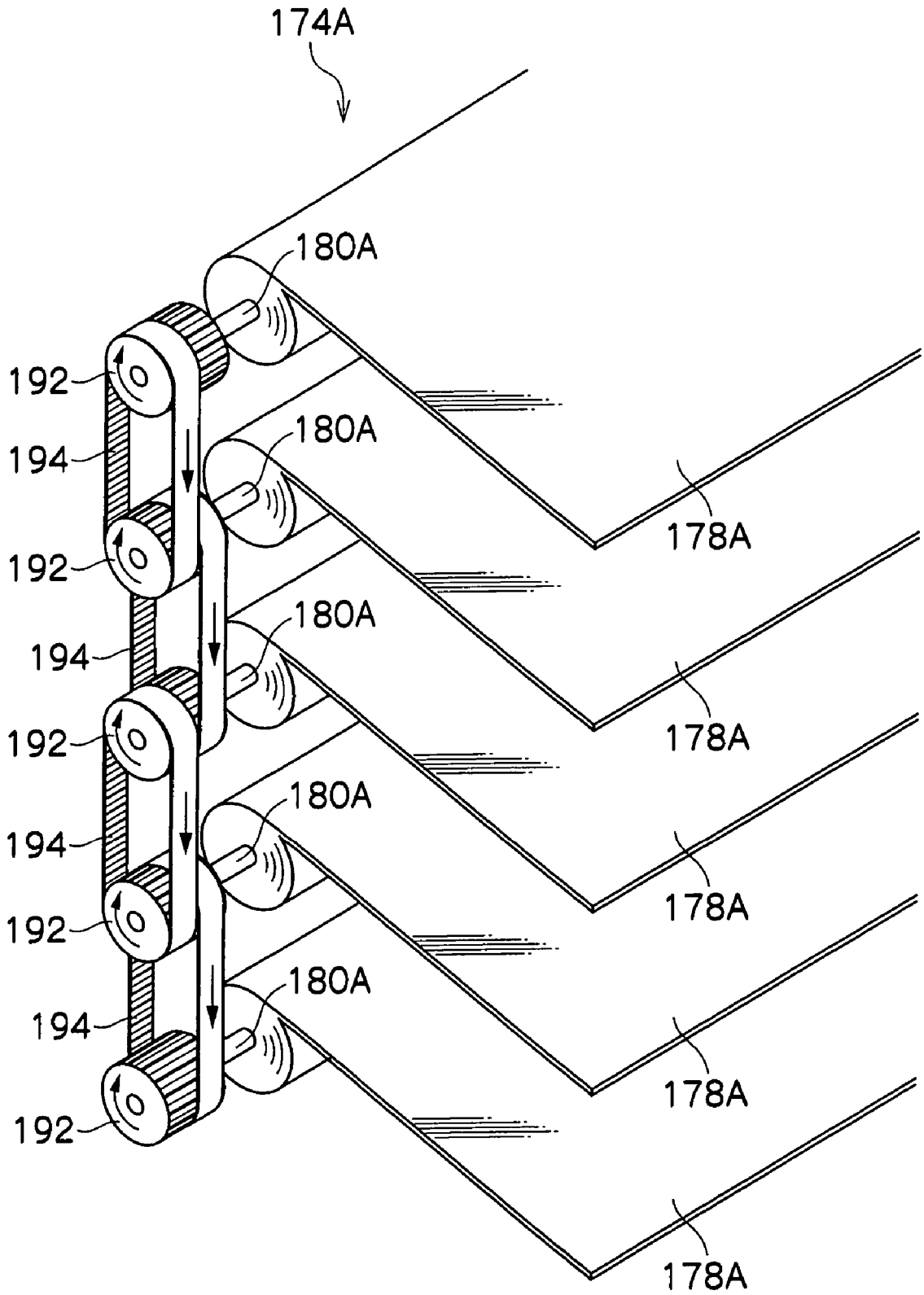
FIG. 13 is a perspective view showing the structure of the temporary stack tray according to the fourth embodiment of the present invention.

Further, as shown in FIG. 13, the rollers 180A are arranged in a vertical array, and each of them has a pulley 192 mounted thereto. A timing belt 194 is entrained about each adjacent pair of the pulleys 192.

Further, as shown in FIG. 12, a stepping motor 188 is provided which imparts a driving force to the uppermost roller 180A. Thus, the uppermost roller 180A is rotated by the stepping motor 188 and in turn the second-uppermost roller 180A is rotated through the timing belt 194. Further, in response to the rotation of the second-uppermost roller 180A, the third-uppermost roller 180A is rotated through the timing belt 194. In this manner, all the rollers 180A are simultaneously rotated. Thus, the plural film trays 178A are unwound from and rewound onto the rollers 180A with the same timing.

Meanwhile, although in this embodiment, a structure has been used in which the vertically arranged rollers 180A are rotated simultaneously through use of the timing belts 194, it is also possible that a structure may be adopted in which a drive motor is connected to each of the rollers 180A and only the motor or motors connected to the roller or rollers which are required to be rotated are driven.

Further, as in the first embodiment, a paper attracting sheet 68 provided with electrodes 70 such as shown in FIG. 5B is adhered to one surface (the surface on which paper P rests) of each film tray 178A. Thus, the paper P is electrostatically attracted and attached to the paper attracting sheet 68 by charging the paper attracting sheet 68. Meanwhile, in this embodiment, a voltage applying device is connected to the electrodes 70 of the paper attracting sheet 68 adhered to each film tray 178A, and the charging of the paper attracting sheet 68 is rendered on and off by rendering on and off the application of a voltage from the voltage applying device.

As shown in FIG. 11, a stack tray accommodating portion 174B is provided on the downstream side of the stack tray accommodating portion 174A with their open sides disposed in opposing relationship to each other. Further, the uppermost roller 180A of the stack tray accommodating portion 174A is located a slightly higher position than the uppermost roller 180B of the stack tray accommodating portion 174B.

Thus, the fore end of the uppermost film tray 178A of the stack tray accommodating portion 174B is located at a position between the fore end of the uppermost film tray 178A and the fore end of the second-uppermost film tray 178A of the stack tray accommodating portion 174A. That is, the fore ends of the film trays 178A and the fore ends of the film trays 178B are alternately located.

Figure 14A:
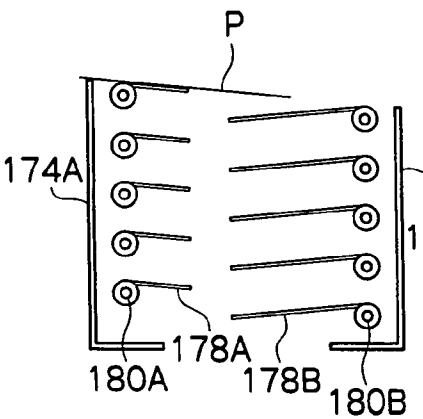
FIGS. 14A to 14D are explanatory views illustrating how paper is conveyed by the temporary stack tray according to the fourth embodiment of the present invention.

Here, it will be described how the paper P conveyed from the conveyor device 24 to the temporary stack tray 172 is conveyed. First, as shown in FIG. 14A, the paper P on the conveyor belt 28 of the conveyor device 24 (see FIG. 11) is conveyed to the uppermost film tray 178A of the stack tray accommodating portion 174A. At this point, the paper attracting sheet 68 on the film tray 178A is charged, and thus the paper P is electrostatically attracted and attached to the film tray 178A (to be precise, the paper attracting sheet 68) in a state in which the fore end of the paper P protrudes from the film tray 178A. Further, the roller 180A is rotated by the driving of the stepping motor 188 (see FIG. 12), and thus the film tray 178A is unwound from the roller 180A.

Figure 14B:
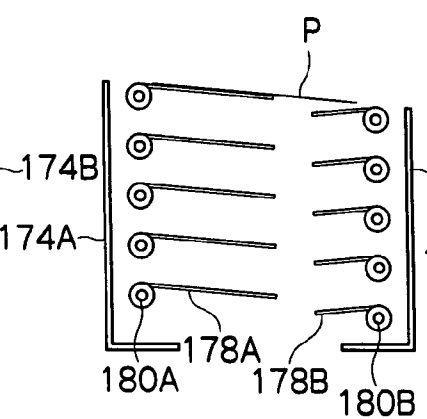
Figure 14C:
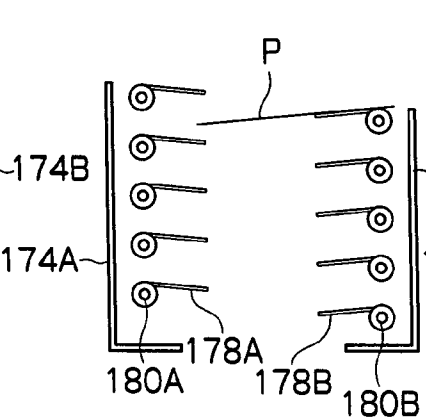
Figure 14D:
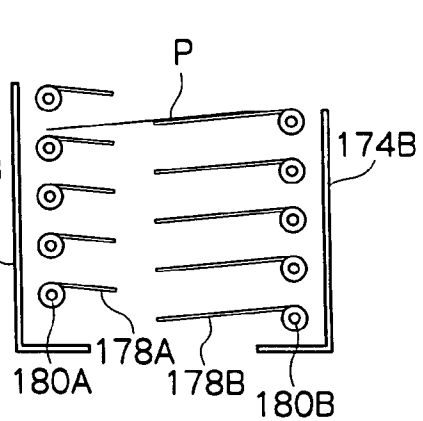

As shown in FIG. 14B, when the film tray 178 is unwound as far as a predetermined position is reached the paper P on the film tray 178A is brought into contact with the uppermost film tray 178A of the stack tray accommodating portion 174B. Here, the paper attracting sheet 68 of the film tray 178A is uncharged, and at the same time, the paper attracting sheet 68 of the film tray 178B of the stack tray accommodating portion 174B is charged. Thus, the fore end of the paper P is electrostatically attracted and attached to the film tray 178B. Further, as shown in FIG. 14C, the film trays 178A of the stack tray accommodating portion 174A are rewound, and consequently the paper P is completely delivered from the uppermost film tray 178A of the stack tray accommodating portion 174A to the uppermost film tray 178B of the stack tray accommodating portion 174B.

When the paper P is delivered to the film tray 178B of the stack tray accommodating portion 174B, the film trays 178B of the stack tray accommodating portion 174B are unwound as shown in FIG. 14B. Subsequently, in a similar manner, the paper P is delivered from the film tray 178B of the stack tray accommodating portion 174B to the second-uppermost film tray 178A of the stack tray accommodating portion 174A.

In this way, the paper P is conveyed downward while being alternately delivered from the film tray 178A of the stack tray accommodating portion 174A to the film tray 178B of the stack tray accommodating portion 174B.

Then, the paper P is delivered to the lowermost film tray 178B of the tack film tray portion 174B, and subsequently the film tray 178B is unwound so that the paper P is delivered to the paper delivery device 42 (see FIG. 11). Further, the paper P is electrostatically attracted and attached to the conveyor belt 46 of the paper delivery device 42 and conveyed in the direction of the arrow B by the rotational movement of the conveyor belt 46 so as to be fed below the recording head unit 38 (see FIG. 1) in an upside-down inverted state. Consequently, an image is formed on the rear surface of the paper P.

The paper P having an image formed thereon is conveyed downward as above, and thus during the time that the paper P is delivered to the paper delivery device 42, drying of the paper P is effected so that deformation such as curl, cockle or the like is corrected. Further, since the paper P is sequentially delivered to the upstream side film trays 178 and the downstream side film trays 178, a tension in the conveying direction is imparted to the paper P, thereby preventing occurrence of cockle or the like on the paper P.

Next, description will be made of a temporary stack tray 202 which is mounted in an image recording apparatus 200 according to a fifth embodiment of the present invention. Meanwhile, further description of the parts similar to those of the first and fourth embodiments will be omitted.

Figure 15:
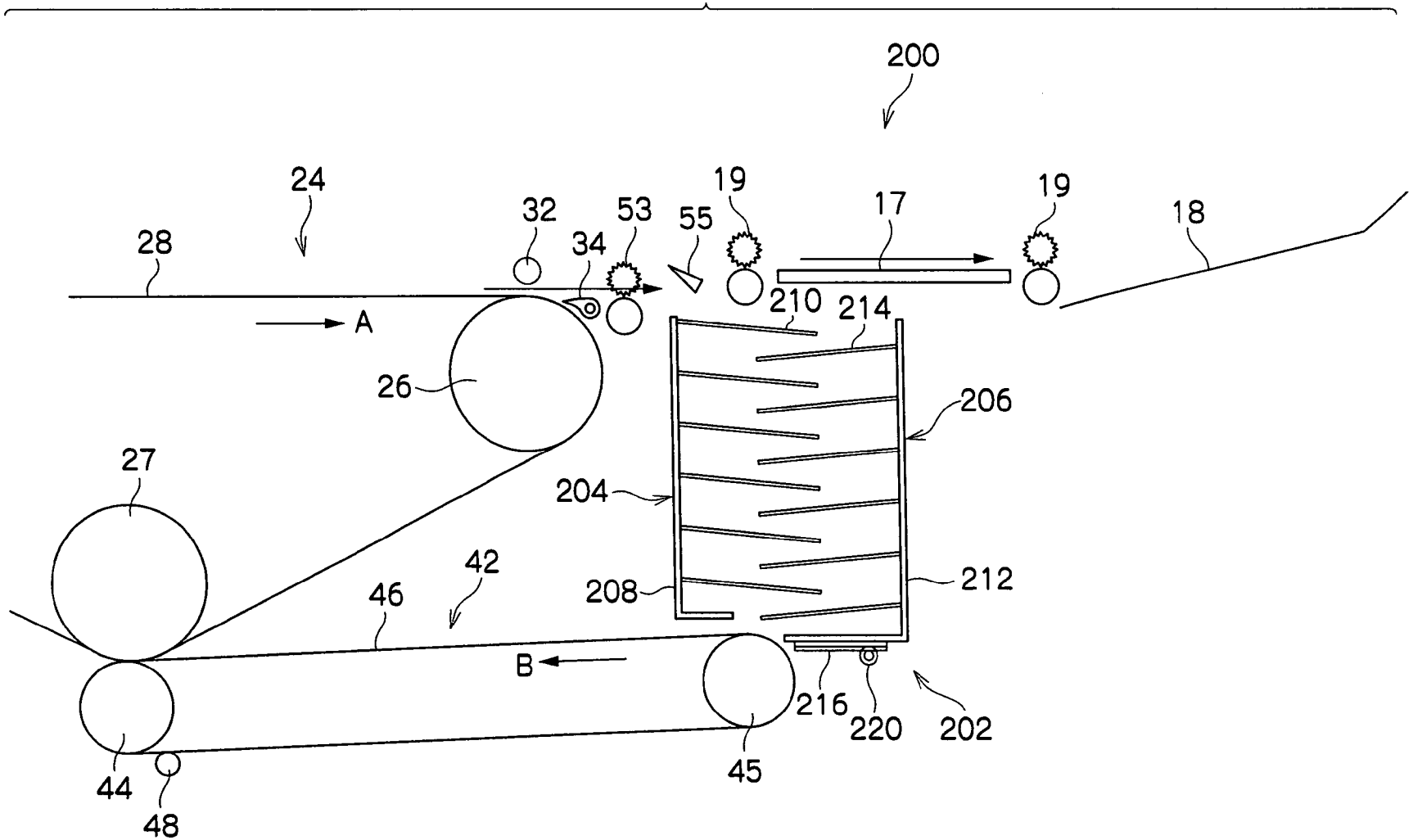
FIG. 15 is a schematic diagrammatic view of a temporary stack tray mounted in an image recording apparatus according to a fifth embodiment of the present invention.

As shown in FIG. 15, the temporary stack tray 202 includes a stationary stack tray accommodating portion 204 which is securely fixed to the image recording apparatus 200. A movable stack tray accommodating portion 206 is provided on the downstream side of the stationary stack tray accommodating portion 204 in a manner capable of being moved toward and away from the stationary stack tray accommodating portion 204.

The stationary stack tray accommodating portion 204 includes a housing 208 which is open at the downstream side of the conveying direction and approximately U-shaped as viewed from above. On a side wall of the housing, there are vertically mounted a plurality of (in this embodiment, five) trays 210 extending in a downwardly inclined manner from the side wall toward the open side.

Further, as in the first embodiment, a paper attracting sheet 68 provided with electrodes 70 such as shown in FIG. 5B is adhered to one surface (the surface on which paper P rests) of each tray 210, thereby permitting the paper P to be electrostatically attracted and attached to the paper attracting sheet 68.

On the other hand, the movable stack stray accommodating portion 206, which has substantially the same structure as the stationary stack tray accommodating portion 204, and is provided on the downstream side of the conveying direction with respect to the stationary stack stray accommodating portion 204 in such a manner that the open side of the housing 212 is disposed in opposing relationship to the open side of the housing 208 of the stationary stack tray accommodating portion 204. At this point, the uppermost tray 210 of the stationary stack tray accommodating portion 204 is located at a slightly higher position than the uppermost tray 214 of the movable stack tray accommodating portion 206. Thus, the fore end of the uppermost film tray 214 of the movable stack tray accommodating portion 206 is located at a position between the fore end of the uppermost tray 210 and the fore end of the second-uppermost tray 210 of the stationary stack tray accommodating portion 204. That is, the fore ends of the trays 210 and the fore ends of the trays 214 are alternately located.

Figure 16:
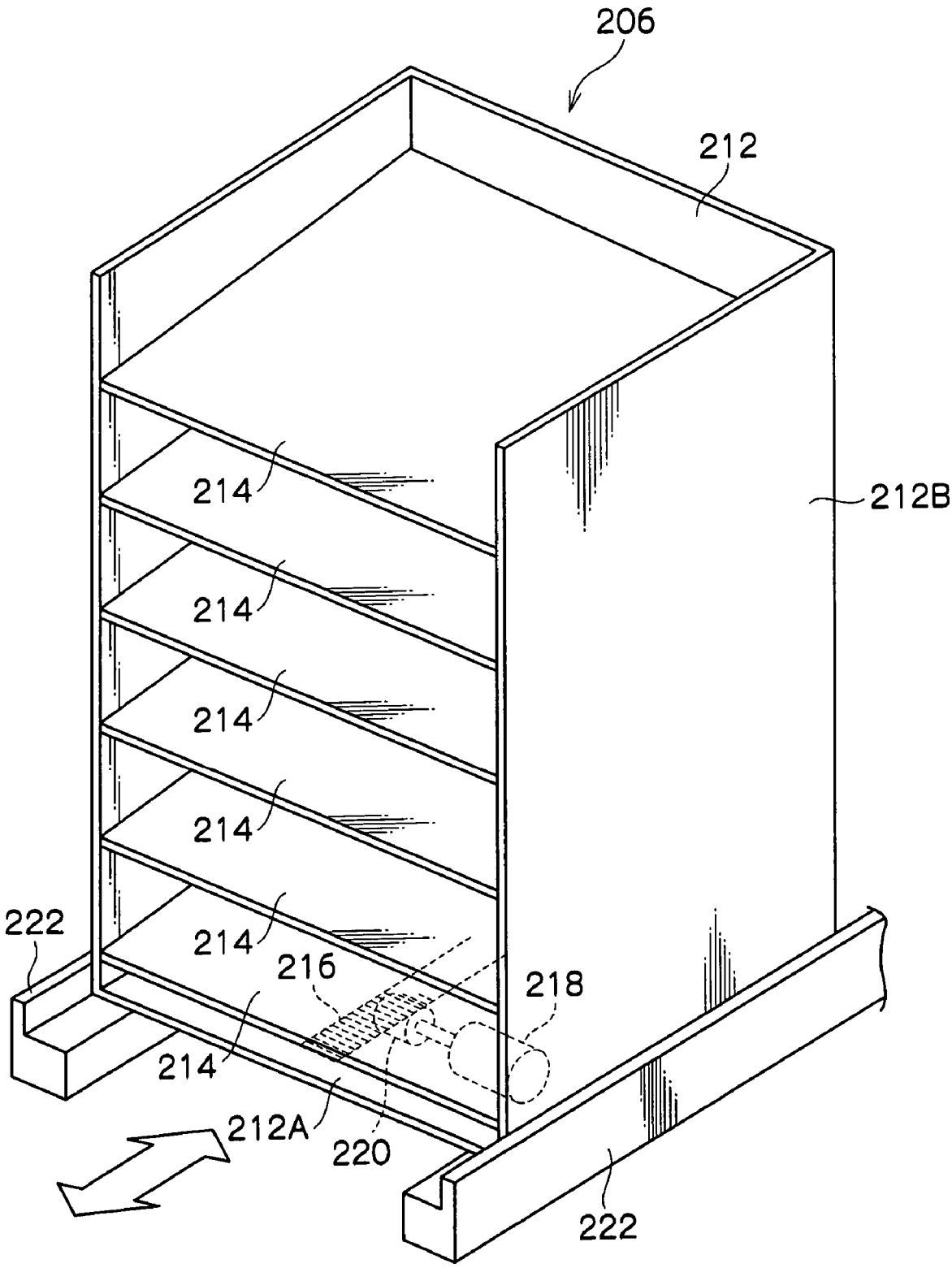
FIG. 16 is a perspective view showing the structure of the temporary stack tray according to the fifth embodiment of the present invention.

As shown in FIG. 16, on the bottom surface 212A of the housing 212 of the movable stack tray accommodating portion 206 at an approximately center portion thereof, there is provided a rack 216 extending along the conveying direction. The rack 216 is disposed in intermeshing relationship with a pinion 220 which mounted on a motor 218. Further, the housing 212 is supported at a side wall 212B and at a bottom plate 212A by a pair of rails 222 which are provided at the bottom of the image recording apparatus 200 body along the conveying direction. Thus, rotation of the motor 218 results in the housing 212 being moved along the conveying direction.

Figures 17A, 17B, 17C, 17D, 17E:
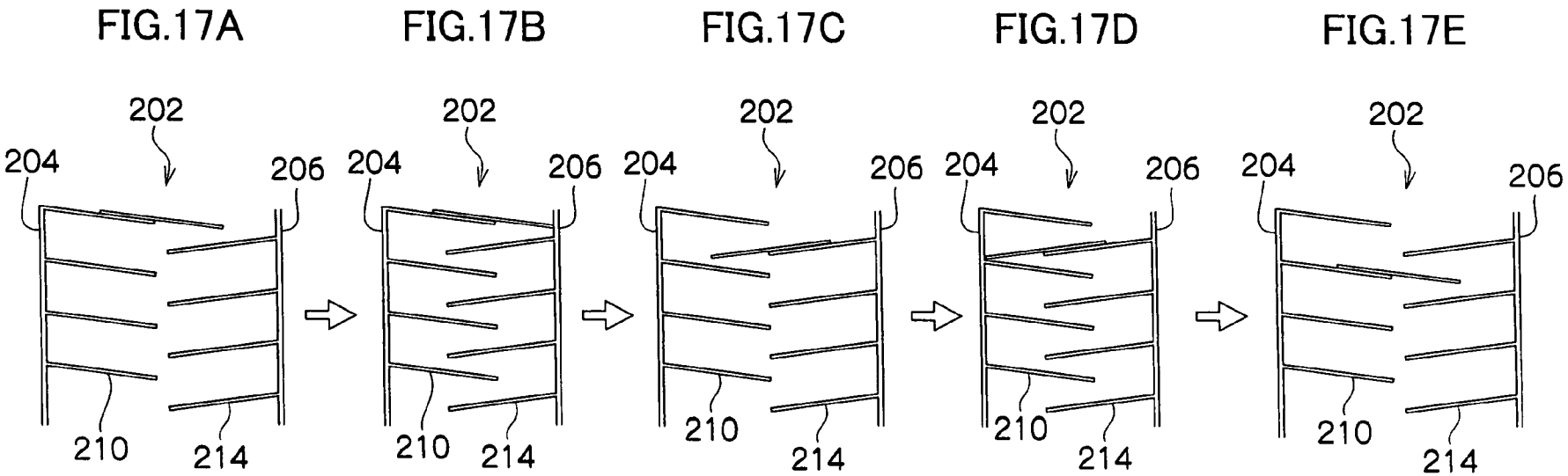
FIGS. 17A to 17E are explanatory views illustrating how paper is conveyed by the temporary stack tray according to the fifth embodiment of the present invention.

Here, it will be described how the paper P conveyed from the conveyor device 24 to the temporary stack tray 202 is further conveyed. First, as shown in FIG. 17A, the paper P on the conveyor device 24 (see FIG. 11) is conveyed to the uppermost tray 210 of the stationary stack tray accommodating portion 204. At this point, the paper attracting sheet 68 of the tray 210 is charged, and thus the paper P is electrostatically attracted and attached to the tray 210.

Subsequently, as shown in FIG. 17B, the motor 218 (see FIG. 16) is driven so as to move the movable stack tray accommodating portion 206 toward the stationary stack tray portion 204. At this point, the charging of the paper attracting sheet 68 of the tray 210 is interrupted, and now the paper attracting sheet 68 of the tray 214 of the movable stack tray accommodating portion 206 is charged. Thus, the paper P on the uppermost tray 210 of the stationary stack tray accommodating portion 204 is electrostatically attracted and attached to the uppermost tray 214 of the movable stack tray accommodating portion 206.

Subsequently, as shown in FIG. 17C, the movable stack tray accommodating portion 206 is moved away from the stationary stack tray accommodating portion 204, and consequently the paper P is completely delivered from the uppermost tray 210 of the stationary stack tray accommodating portion 204 to the uppermost tray 214 of the movable stack tray accommodating portion 206.

Now, as shown in FIG. 17D, the movable stack tray accommodating portion 206 is moved toward the stationary stack tray accommodating portion 204; the paper attracting sheet 68 of the tray 210 of the stationary stack tray accommodating portion 204 is charged; and the charging of the paper attracting sheet 68 of the tray 214 of the movable stack tray accommodating portion 206 is interrupted. Thereupon, the paper P on the tray 214 of the movable stack tray accommodating portion 206 is electrostatically attracted and attached to the second-uppermost tray 210 of the stationary stack tray accommodating portion 204.

Further, as shown in FIG. 17E, the movable stack tray accommodating portion 206 is moved away from the stationary stack tray accommodating portion 204, and consequently, the paper P is completely delivered from the uppermost tray 214 of the movable stack tray accommodating portion 206 to the second-uppermost tray 210 of the stationary stack tray accommodating portion 204.

In the above manner, the paper P is conveyed downward while being delivered alternately between the trays 210 of the stationary stack tray accommodating portion and the trays 214 of the movable stack tray accommodating portion.

The paper P delivered to the lowermost tray 214 of the movable stack tray accommodating portion 206 is electrostatically attracted and attached to the conveyor belt 46 of the paper delivery device (see FIG. 15) when the movable stack tray accommodating portion 206 is moved toward the stationary stack tray accommodating portion 204 and the charging of the paper attracting sheet 68 of the tray 214 is interrupted. Thus, due to the rotational movement of the conveyor belt 46, the paper P is conveyed in the direction of the arrow B so as to be fed below the recording head unit 38 (see FIG. 1) in an upside-down inverted state.

The paper P having an image formed thereon is conveyed downward as above, and thus during the time that the paper P is delivered to the paper delivery device 42, drying of the paper P is effected so that deformation such as curl, cockle or the like is corrected.

Description will next be made of a temporary stack tray 244 which is mounted in an image recording apparatus 230 according to a sixth embodiment of the present invention. Meanwhile, further description of the parts similar to those of the first embodiment will be omitted.

Figure 18:
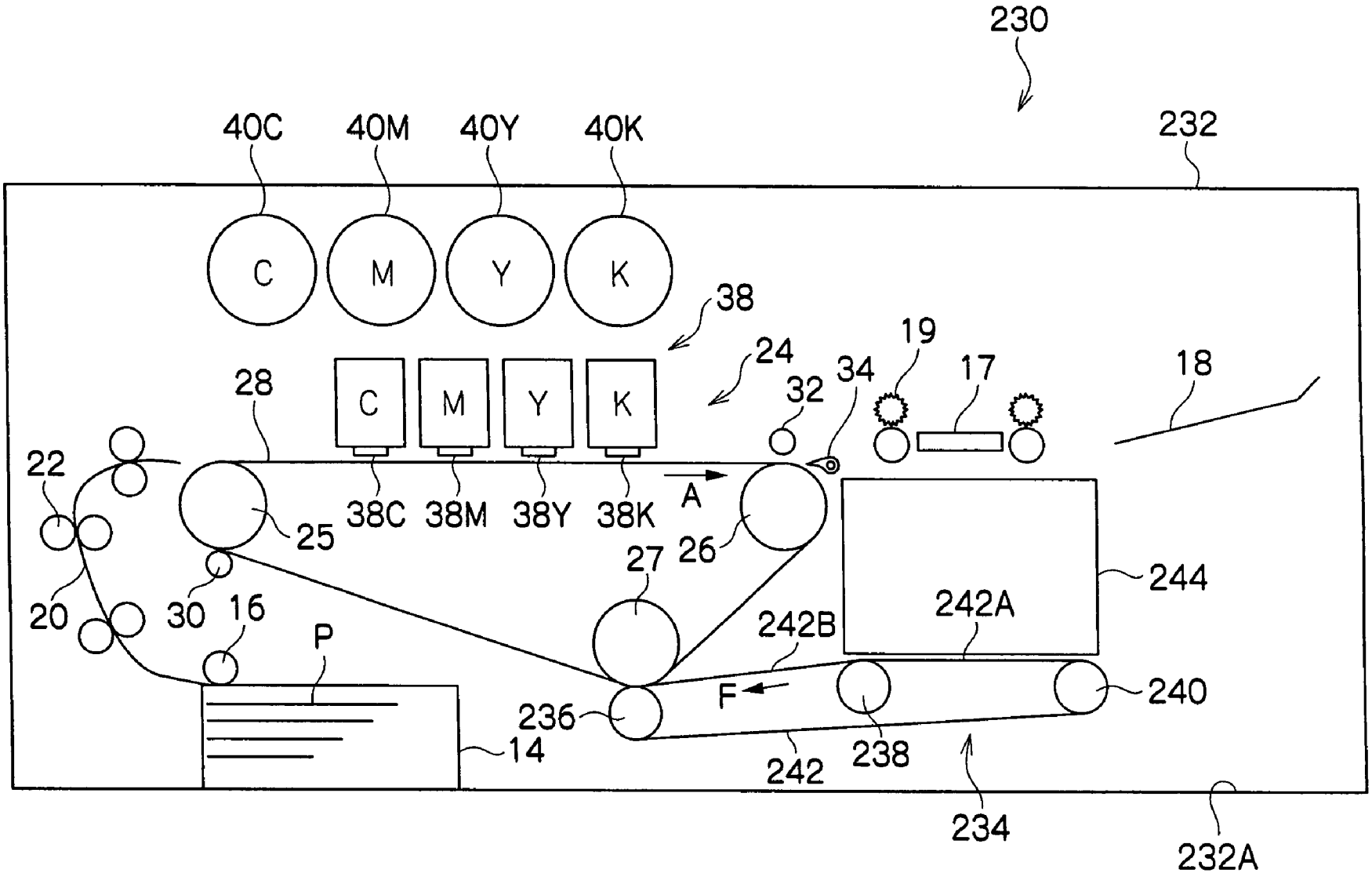
FIG. 18 is a schematic diagrammatic view of an image recording apparatus according to a sixth embodiment of the present invention.
Figure 19:
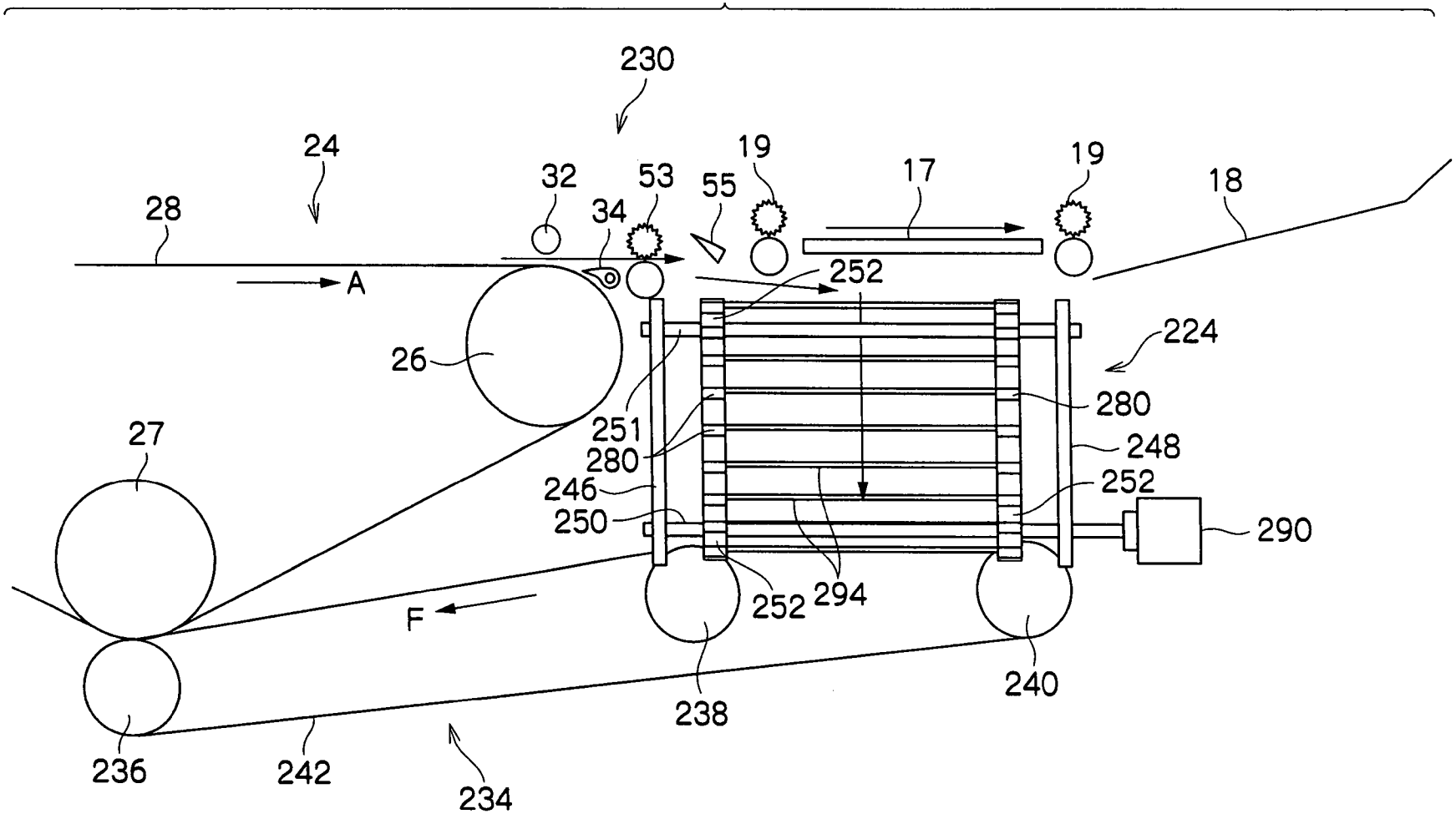
FIG. 19 is a schematic diagrammatic view of a temporary stack tray mounted in the image recording apparatus according to the sixth embodiment of the present invention.

As shown in FIGS. 18 and 19, a delivery device 234 includes a roller 236 provided adjacent to the roller 27 of the conveyor device 24, a roller 238 provided at a position that is more downstream of the conveying direction than, and obliquely above, the roller 236, and a roller 240 provided at a downstream side of the conveying direction relative to the roller 238 and substantially in parallel therewith. An endless conveyor belt 242 is entrained about the rollers 236, 238 and 240. Thus, a conveyance surface 242A formed by being entrained about the rollers 238 and 240 is disposed in substantially parallel relationship with a bottom surface 232A of the image recording apparatus, and a conveyance surface 242B formed by being entrained about the rollers 236 and 238 is sloped downward toward the roller 236.

Further, the roller 236 is connected to an unillustrated drive motor, and it is arranged that the conveyor belt 242 is rotationally moved in a predetermined direction (direction of an arrow F) in response to the roller 236 being rotated by rotational driving of the drive motor.

Figure 20:
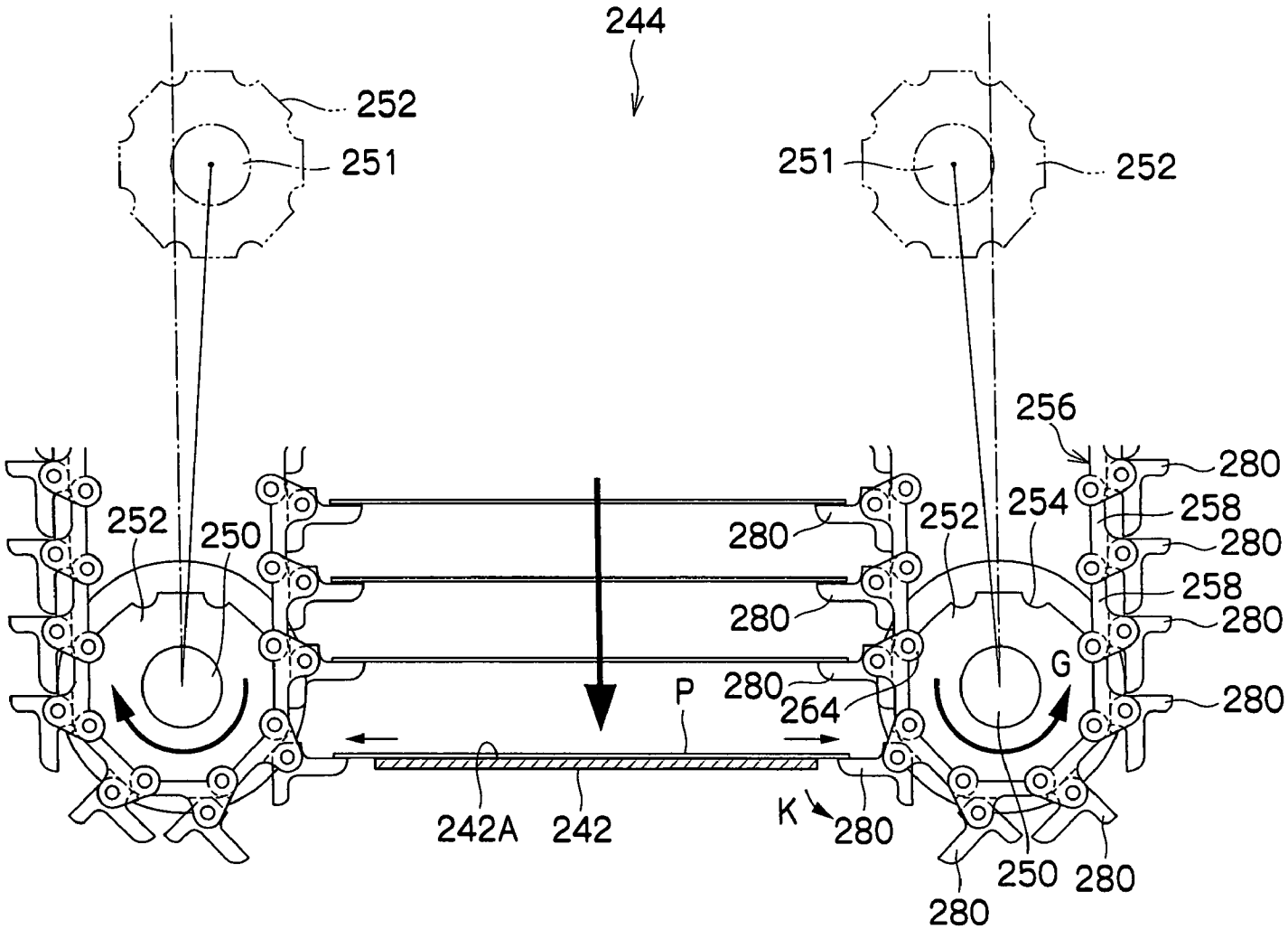
FIG. 20 is a schematic view illustrating a state in which the temporary stack tray mounted in the image recording apparatus according to the sixth embodiment of the present invention is viewed from a conveying direction.

The temporary stack tray 244 is provided above the conveyance surface 242A of the conveyor belt 242. As shown in FIGS. 19 and 20, the temporary stack tray 244 includes support frames 246 and 248 having a size greater than the width of the conveyor belt 242. The support frames 246 and 248 are provided above the rollers 238 and 240 and perpendicularly with respect to the conveyor belt 242.

Four shafts 250 and 251 are rotatably supported at the four corners of the support frames 246 and 248 in a manner to straddle the support frames 246 and 248. Gears 252 are mounted on opposite end portions of the shafts 250 and 251 which are more inward than the support frames 246 and 248. On the outer circumference of the gears 252 are formed a plurality of arcuate recesses 254 which are circumferentially spaced apart from each other a predetermined distance. It is arranged that bearing portions 264 of chains 256 are engaged with the recesses 254.

Figure 21:
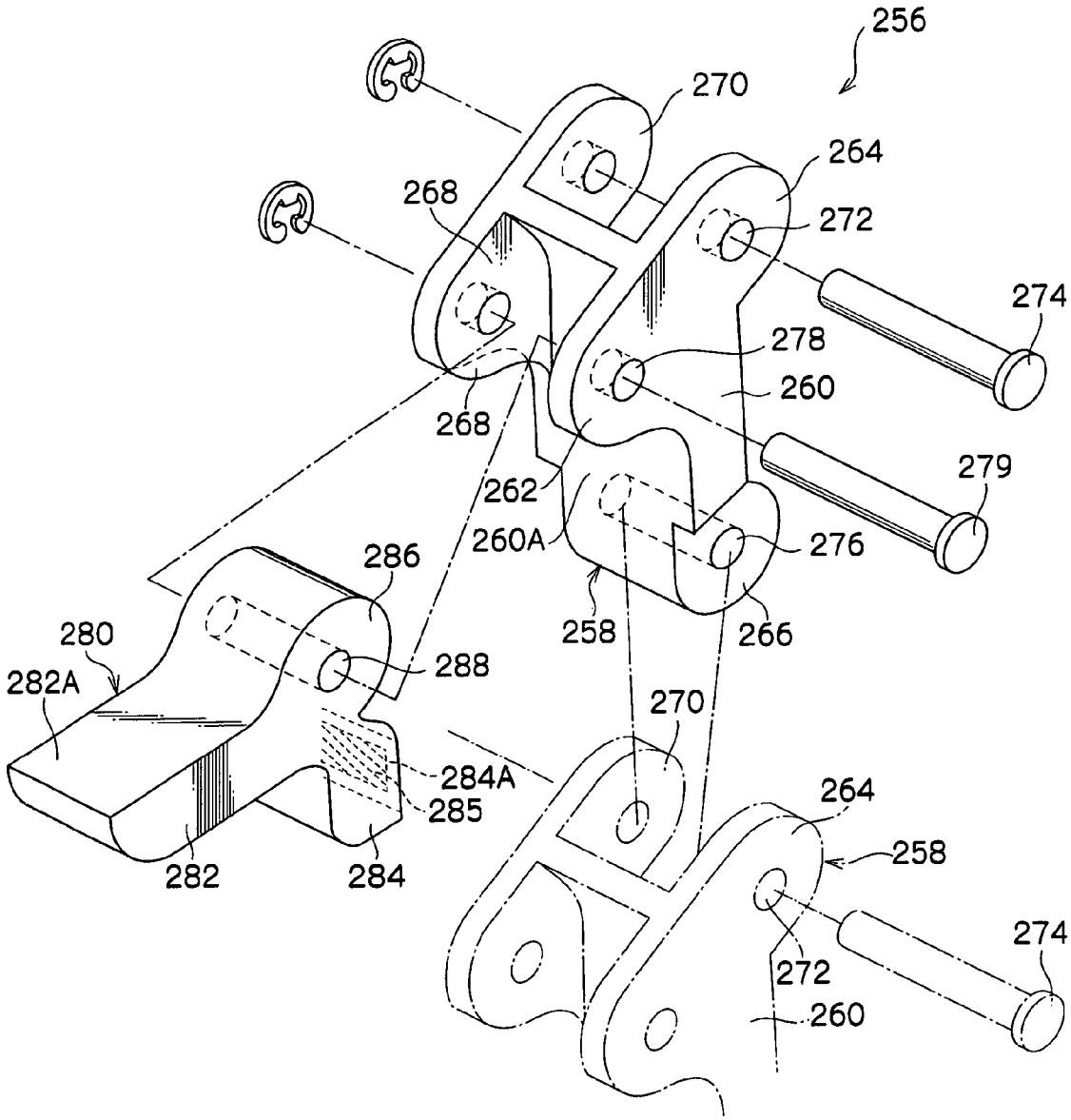
FIG. 21 is a perspective view showing the relationship between a chain to constitute the temporary stack tray mounted in the image recording apparatus according to the sixth embodiment of the present invention and a paper support arm.

As shown in FIG. 21, the chain 256 is made up by connecting a number of links 258 to the bearing portions 264. Each link 258 is comprised of a base body 260 having a predetermined thickness, and bearing portions 262, 264, and 266 which are protrudingly provided on the outer perimeter of the base body 260. The bearing portion 262 has a recess 268 formed in an inner portion in the thickness-wise direction thereof, and a bearing portion 286 of a paper support arm 280 made from a non-conductive material is fitted in the recess 268.

Further, the bearing portion 266 is configured such that it is smaller than the base body 260 in the thickness-wise direction and adapted to be fitted in a recess 270 formed in the bearing portion 264 of another link 258. Further, a shaft 274 is inserted through apertures 272 formed through the bearing portion 264 and an aperture 276 formed through the bearing portion 266 which is fitted in the recess 270 of the bearing portion 264, and thus one link 258 is rotatably coupled to another link 258.

On the other hand, the paper support arm 280 is formed in an approximate T-shape by an arm portion 282 having a support surface 282A for supporting paper P, and a support piece 284 provided substantially perpendicularly with respect to the arm portion 282. At one end of the support piece 284, there is provided a bearing portion 286 which is fitted in a recess 268 formed in the bearing portion 262 of the link 258. An aperture 288 is formed through the bearing portion 286. A shaft 279 is inserted through apertures 278 formed through the bearing portion 262 of the link 258 and the aperture 288, and thus the paper support arm 280 is rotatably attached to the link 258.

As shown in FIG. 20, the chain 256 is entrained about two gears 252 which are vertically located. A motor 290 (see FIG. 19) is coupled to a shaft 250 of the below located gear 252. The shaft is rotated in the direction of an arrow G by the motor 290, and thus the chain 256 is rotationally moved in the direction of the arrow G via the gears 252 mounted on the shafts 250 and 251 respectively. Concomitantly, the paper support arm 280 is moved along the direction of the arrow G.

Figure 22:
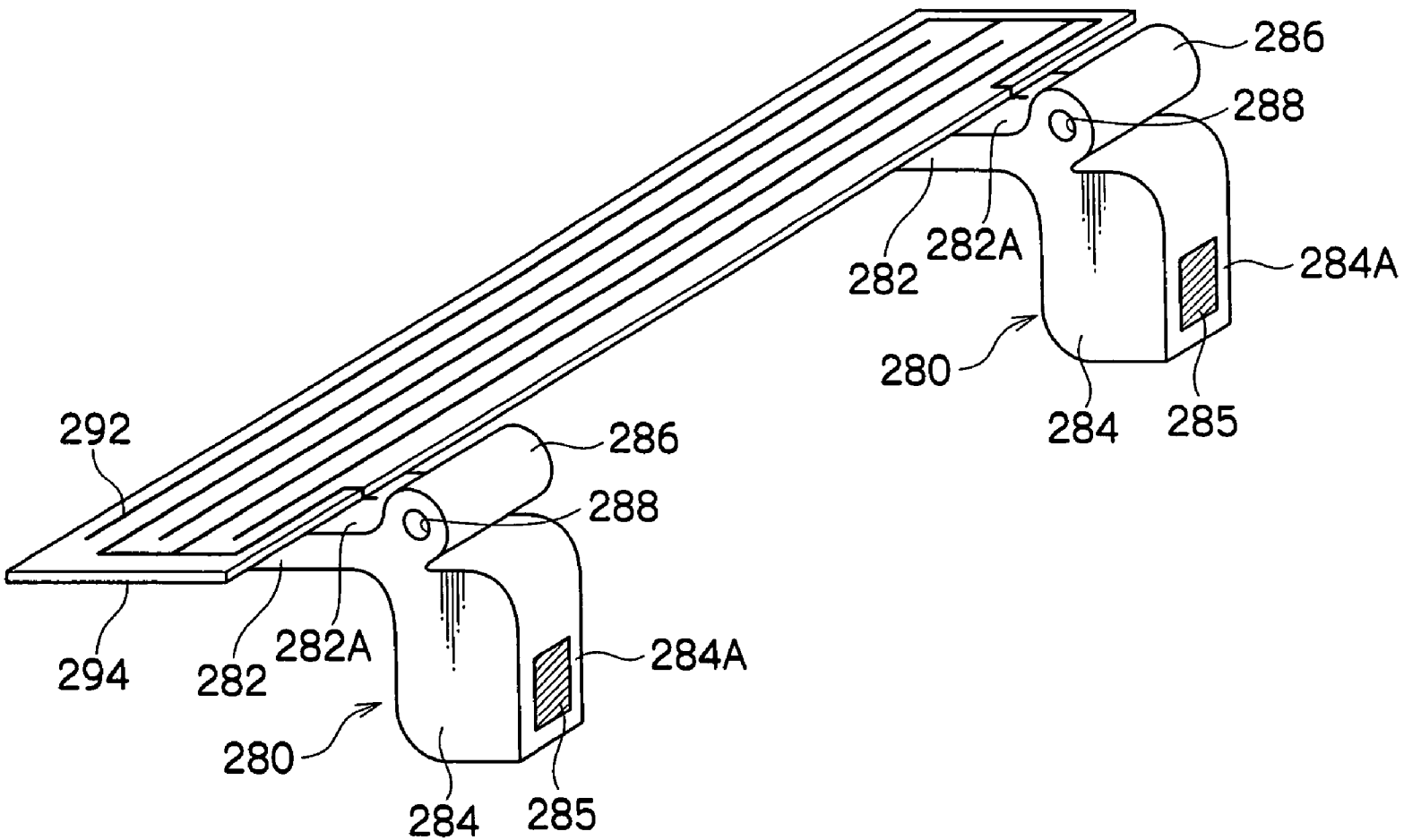
FIG. 22 is a perspective view showing paper support arms to constitute the temporary stack tray mounted in the image recording apparatus according to the sixth embodiment of the present invention.

As shown in FIG. 22, an electrostatic attracting pad 294 is adhered to the two paper support arms 280 which are provided on the same plane along the conveying direction in such a manner as to straddle the two paper support arms 280. Electrodes 292 are provided in the electrostatic attracting pad 294. The electrostatic attracting pad 294 is charged by applying a voltage to the electrodes 292 so that an electrostatic attraction force is generated on a support surface 282, thereby electrostatically attracting and attaching the paper P thereto.

On the other hand, the paper support arm 280 is provided with a conductive member 285 which is electrically connected to the electrodes 292 via an unillustrated wiring. Further, an unillustrated voltage applying device is connected to the chain 256.

In the above structure, when the paper support arm 280 is located in a region in which the paper P is conveyed (the space immediately above the conveyor belt 242), a side surface 284A of the support piece 284 of the paper support arm 280 is placed in contact with a side surface 260A of the base body 260 of the chain 256 so that the chain 256 and the conductive member 285 of the paper support arm 280 are placed in electric contact with each other. Thus, when a voltage is applied to the chain 256, electric energy is transmitted from the chain 256 to the paper support arm 280, and thus the electrostatic attracting pad 294 is charged so that an electrostatic attraction force is generated on the support surface 282A.

When the paper support arm 280 is located at the portion of the chain 256 which is entrained about the gear 252, the paper support arm 280 is rotated in the direction of an arrow K due to its own weight. Thus, the side surface 284A of the support piece 284 of the paper support arm 280 is placed out of contact with the side surface 260A of the base body 260 of the chain 256 so that the voltage applied to the chain 256 is no longer transmitted to the paper support arm 280.

When the paper support arm 280 is located in a region other than the region in which the paper P is conveyed (space opposite to the space immediately above the conveyor belt 242), the side surface 284A of the support piece 284 of the paper support arm 280 is placed out of contact with the side surface 260A of the base body 260 of the chain 256. That it, the voltage applied to the chain 256 is not transmitted to the paper, and hence no electrostatic attraction force is generated on the support surface 282A.

The paper support arm 280 located in the portion of the chain 256 which is entrained about the gear 252 is rotated due to its own weight in the vicinity of the region in which the chain 256 becomes rectilinear. Consequently, the side surface 284A of the support piece 284 of the paper support arm 280 is placed in contact with the side surface 260A of the base body 260 of the chain 256, and thus the chain 256 and the conductive member 285 of the paper support arm 280 are placed in electric contact with each other.

In the above structure, as shown in FIG. 19, when the paper P on the conveyor device 24 is fed into the temporary stack tray 244, the paper P is electrostatically attracted and attached to the electrostatic attracting pad 294 which is placed in electric contact with the chain 256, and conveyed downward due to the rotation of the gears 252 in the direction of the arrow G, as shown in FIG. 20.

Further, when the paper support arm 280 is moved to a height substantially the same as the conveyance surface 242A of the conveyor belt 242 of the delivery device 234, the rotational movement of the chain 256 permits the paper support arm 280 to be rotated about the shaft 279 due to its own weight.

When the paper support arm 280 is rotated as above, the conductive member 285 is placed out of contact with the side surface 260A of the base body 260 of the chain 256, the electrostatic attracting force is interrupted, and at this timing, the paper P is electrostatically attracted and attached to the conveyor belt 242. Further, the paper P is conveyed in the direction of arrow F due to the rotational movement of the conveyor belt 242, nipped between the roller 27 and the roller 236, and electrostatically attracted and attached to the conveyor belt 28 of the conveyor device 24. Thus, the paper P is fed below the recording head unit 38 (see FIG. 1) in an upside-down inverted state.

As shown in FIG. 20, the distance between the below-located shafts 250 is set to be greater than the distance between the above-located shafts 251. Thus, when the paper support arm 280 is moved from above to below, the support surface 282 is gradually moved horizontally outward. Thus, the paper P whose opposite ends parallel to the conveying direction are electrostatically attracted and attached to the support surface 282A of the paper support arm 280, as it is moved downward, is subjected to an outward tension, whereby deformation such as curl or cockle occurring in the width-wise direction of the paper P is corrected at this point.

Figure 25:
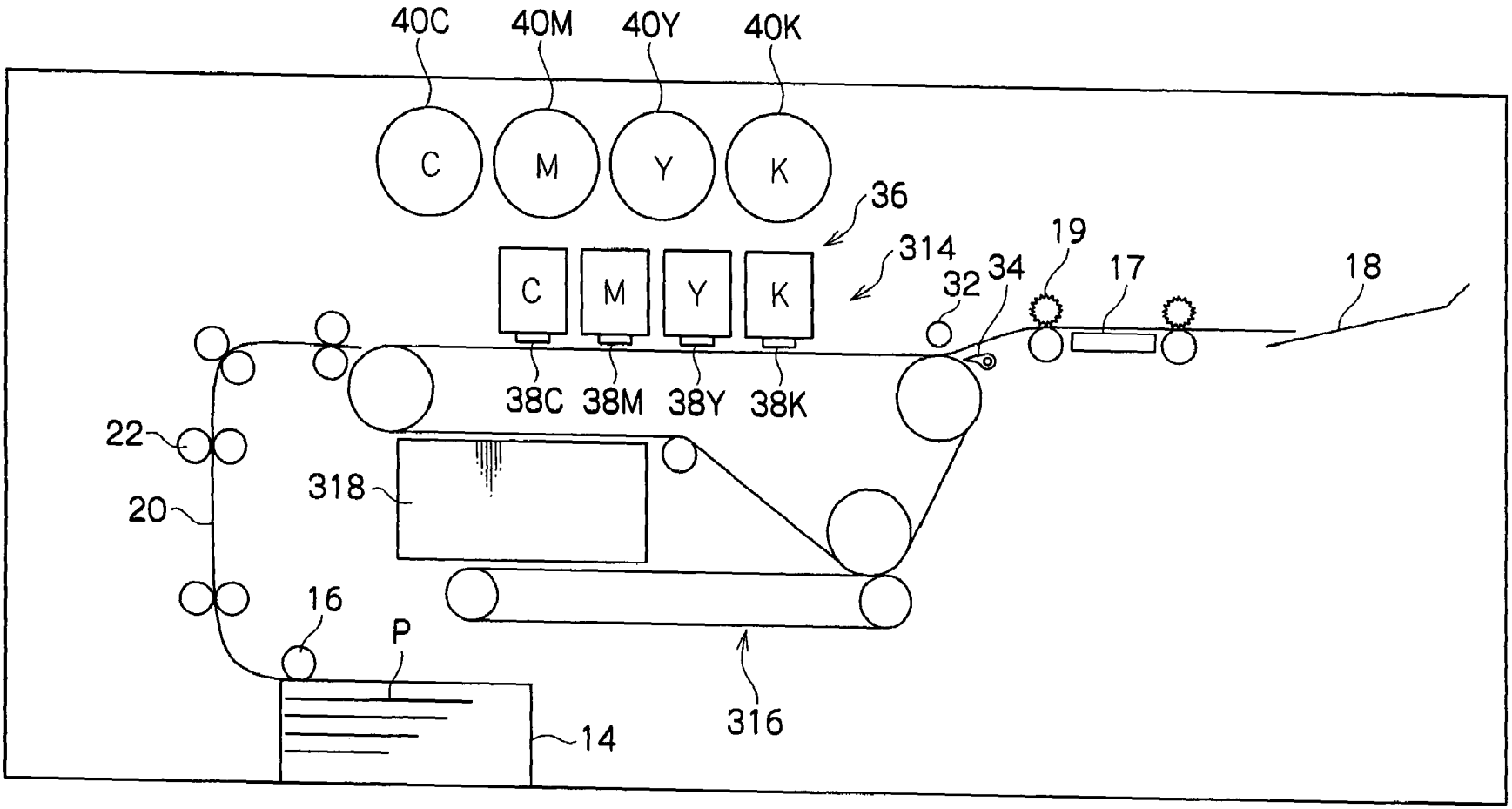
FIG. 25 is a schematic diagrammatic view showing a further form of the image recording apparatus according to the present invention.

Further, although in this embodiment, a structure has been adopted in which the paper P conveyed from the conveyor device 24 (see FIG. 18) is conveyed from above to below by the temporary stack tray 244, it is also possible to adopt a structure in which, as shown in FIG. 25, the paper P is first fed from a conveyor device 314 to a paper delivery device 316, and the paper P delivered from the paper delivery device 316 is conveyed from below to above by a temporary stack tray 318 provided at the downstream side of the paper delivery device 314 so as to be fed in the conveyor device 314. When such a structure is employed, the distance between the below-located shafts 250 is set to be smaller than the distance between the above-located shafts 251 so that the paper P electrostatically attracted and attached to the paper support arm 280 is subjected to an outward tension as it is moved upward.

Next, description will be made of a temporary stack tray 302 which is mounted in an image recording apparatus 300 according to a seventh embodiment of the present invention. Meanwhile, further description of the portions similar to those of the first and sixth embodiments will be omitted.

Figure 23:
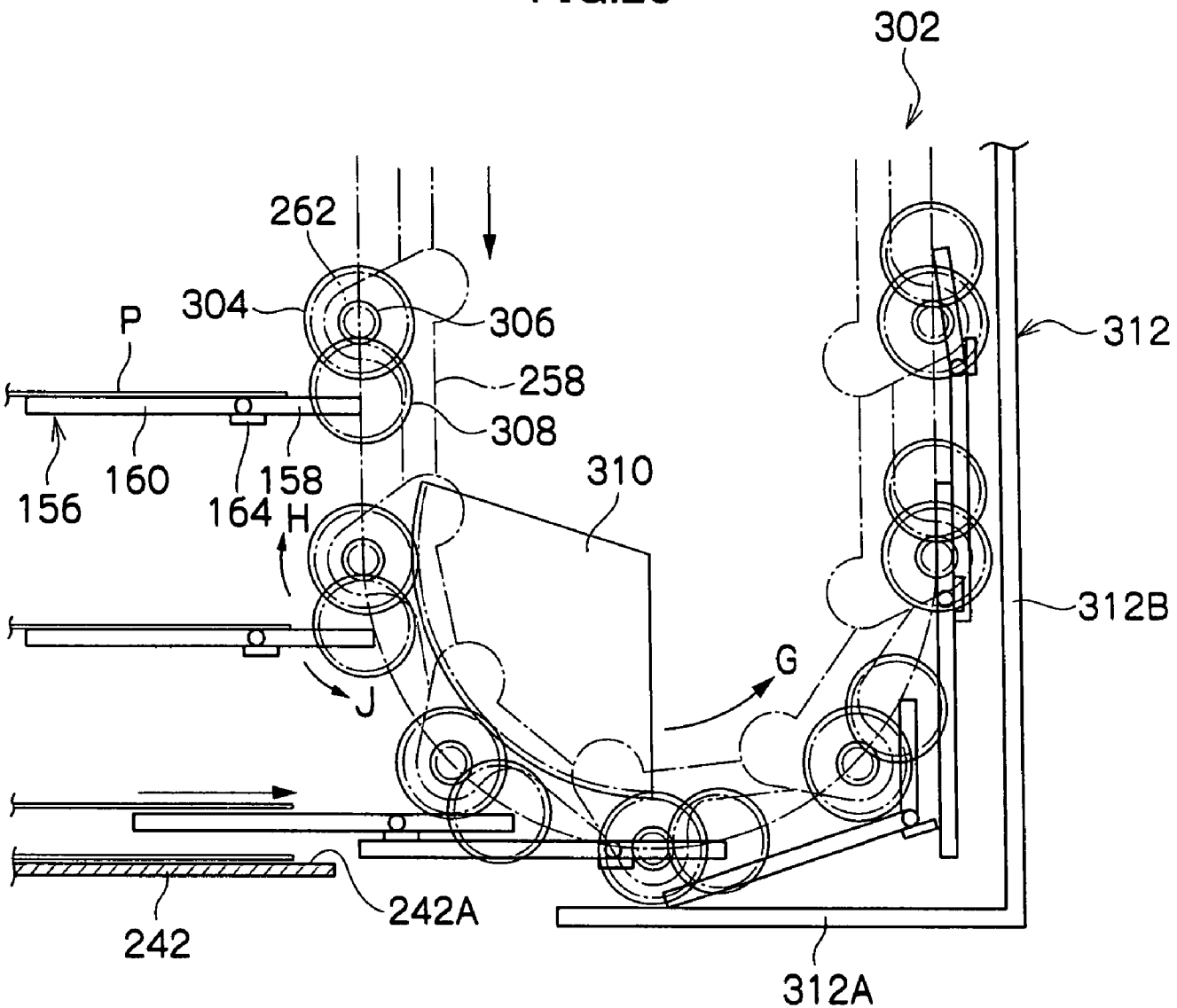
FIG. 23 is a schematic view illustrating a state in which the temporary stack tray mounted in the image recording apparatus according to the seventh embodiment of the present invention is viewed from the side.

As shown in FIG. 23, gears 304 are mounted to the bearing portions of the chain 256 of the temporary stack tray 302. Each of the gears 304 is coaxially provided with a gear 306 which has a smaller diameter than the gear 304 and is rotatable integrally with the gear 304. Each of the gears 306 is meshed with a gear 308 which is rotated in a direction opposite to the direction of rotation of the gears 304 and 306, while the gear 306 is rotated in the same direction as the gear 304 in response to the rotation of the gear 304. To the gear 308 is attached one end of a foldable plastic tray 156 which is similar to that of the third embodiment shown in FIG. 10.

As in the third embodiment, a paper attracting sheet 68 such as shown in FIG. 5B is adhered to the plastic tray 156 so that the paper P is electrostatically attracted and attached to the plastic tray 156.

In the vicinity of the gears 252 (see FIG. 20), there are provided gears 310 having a fan-like shape corresponding to about one-fourth of the complete circumference and the circumferential surface of which faces from the conveyance region (space immediately above the conveyor belt 242) to a position opposing the conveyor belt 242 of the paper delivery device 234. Thus, due to the rotational movement of the chain 256, the gears 304 are moved to positions near the gears 310 and then meshed with the gears 310.

The paper P fed in the temporary stack tray 302, due to the rotational movement of the conveyor belt 28 of the conveyor device 24 (see FIG. 15), is electrostatically attracted and attached to the uppermost plastic tray 156. Further, the paper P is conveyed downward as a result of the plastic tray 156 being moved downward in response to the rotational movement of the chain 256.

The gears 304, when meshed with the gears 310, are forcibly rotated in the direction of an arrow H, and the gears 306 are also rotated in the direction of the arrow H simultaneously with the rotation of the gears 304 so that the gears 308 are rotated in a direction (direction of an arrow J) opposite to the direction of the arrow H. Thus, the plastic trays 156 which tend to be inclined when no external force is imparted thereto are moved downward while maintaining a state in which the support surface 156A supporting the paper P is parallel with the bottom surface of the image recording apparatus 300.

When the plastic tray 156 is moved to a position near the conveyance surface 242A of the conveyor belt 242, the paper P on the plastic tray 156 is electrostatically attracted and attached to the conveyor belt 242 of the paper delivery device 234. Thus, the paper P is delivered from the plastic tray 156 onto the conveyor belt 242.

In order that the plastic trays 156 are moved in a horizontal state to the lowermost position, it is required that the following relationship hold:

$$r_0/r_1=r_3/r_2$$

where $r_0$ is the radius of rotation of the gear 310; $r_1$ is the radius of rotation of the gear 304; $r_2$ is the radius of rotation of the gear 306; and $r_3$ is the radius of rotation of the gear 308.

Figure 24:
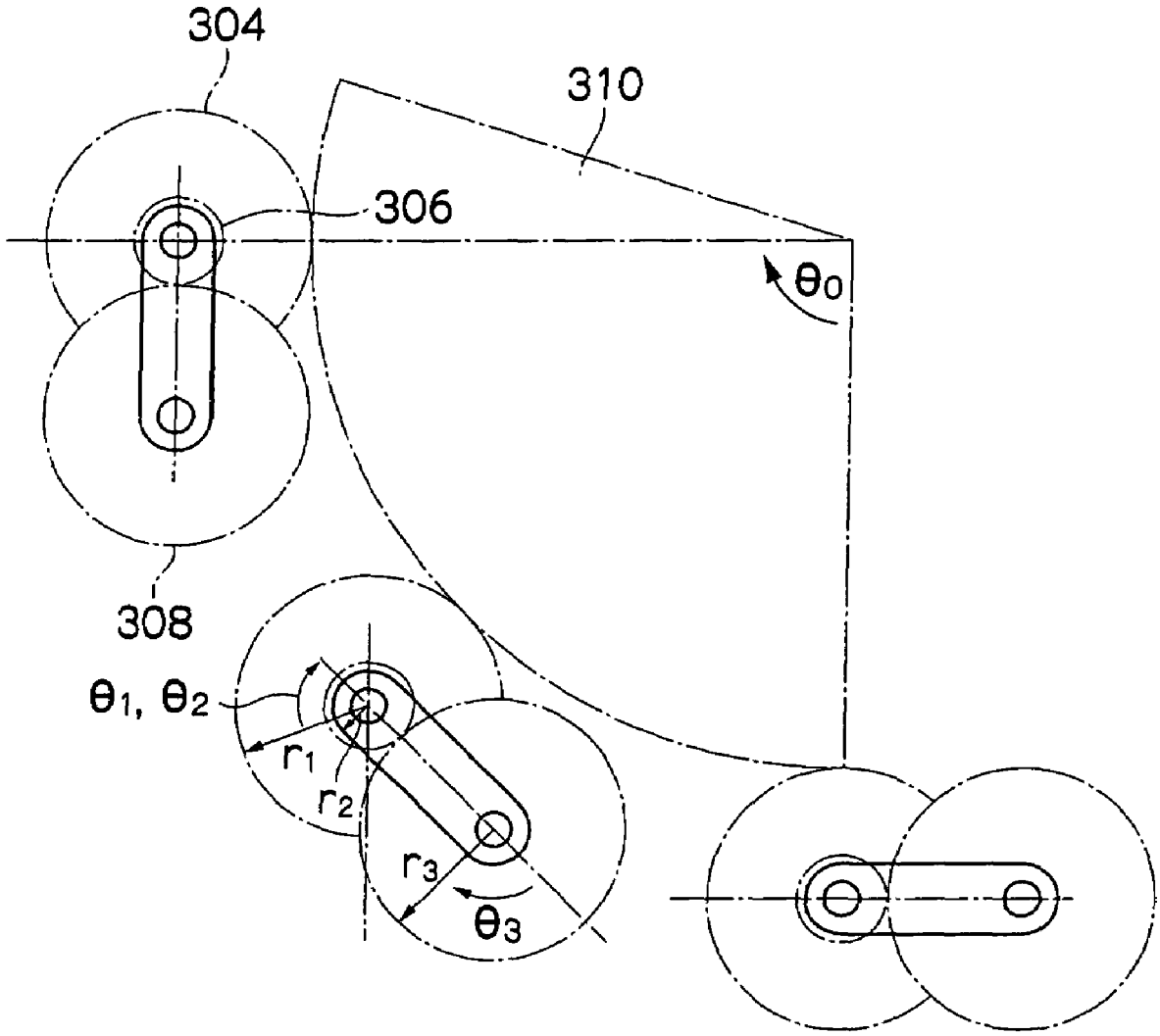
FIG. 24 is an explanatory view showing the relationship in gear ratio between gears supported by the temporary stack tray mounted in the image recording apparatus according to the seventh embodiment of the present invention.

Here, description will be made of the relationships in radius of rotation among the gears 304, 306, 308, and 310 based on FIG. 24. Assume that the gears 310, 304, 306, and 308 are represented by gears 0, 1, 2, and 3 respectively; the radius of rotation of a respective gear n is $r_n$; and the angle of rotation is $\theta_n$ (rightward is positive). Then, the relational expression between the gear 0 and the gear 1 is as follows:

$$\theta_1=(r_0/r_1+1)\theta_a-(r_0/r_1)\theta_0 \quad (1)$$

where $r_0\theta_0+r_1\theta_1=(r_0+r_1)\theta_a$

Further, the relational expression between the gear 2 and the gear 3 is as follows:

$$\theta_2=(1+r_3/r_2)\theta_b-(r_3/r_2)\theta_3 \quad (2)$$

where $r_2\theta_2+r_3\theta_3=(r_2+r_3)\theta_b$

Here, since the gear 1 and the gear 2 are coaxial and integral with each other, it follows that $\theta_1=\theta_2$, i.e., the equation (1) and the equation (2) have equality. Thus, the following equation holds:

$$(r_0/r_1+1)\theta_a-(r_0/r_1)\theta_0=(1+r_3/r_2)\theta_b-(r_3/r_2)\theta_3 \quad (3)$$

Here, based on the operational condition of the mechanism to make constant the orientation of the gear 3, the following relationships holds:

$$-\theta_a=-\theta_b,\ \theta_0=0 \text{ (fixed)},\ \theta_3=0 \text{ (constant orientation)}$$

By substituting the above conditional expressions in the equation (3), the ratio of the radii of rotation of the respective gears is expressed as follows:

$$r_0/r_1=r_3/r_2$$

By setting the radii of rotation of the respective gears 304, 306, 308 and 310 such that the above relational expression hold, the plastic trays 156 are permitted to move as far as the lowermost end while maintaining a horizontal state.

When the paper P is delivered from the plastic tray 156 to the conveyor belt 242, the meshing between the gear 304 and the gear 310 is released due to the rotational movement of the chain 256. Thus, the gear 304 is stopped from being forcibly rotated, and moved in a state fixed to the chain 256, due to the rotational movement of the chain 256. At this point, one end of the plastic tray 156 (the portion thereof which is mounted to the gear 304) is placed in contact with the bottom surface 312A of the housing 312, and thereupon the plate portion 160 is folded toward the plate portion 158. Further, when the plastic tray 156 is moved to the side of the side wall 312B of the housing 312 due to further rotational movement of the chain 256, the plastic tray 156 is oriented so as to assume a state in which it is along the chain 256.

When the plastic tray 156 is located in a region other than the conveyance region as above, the radius of rotation of the tray conveyor device 154 can be made small. Thus, the image recording apparatus 300 does not become bulky.

In this embodiment, as in the sixth embodiment, it is also possible to adopt a structure in which, as shown in FIG. 25, the paper P is first fed from the conveyor device 314 into the paper delivery device 316, and the paper P delivered from the paper delivery device 316 is conveyed from below to above by the temporary stack tray 318 provided at the downstream side of the paper delivery device 314 so as to be fed in the conveyor device 314.

Description will next be made of a temporary stack tray 322 which is mounted in an image recording apparatus 320 according to an eighth embodiment of the present invention. Meanwhile, further description of parts similar to those of the first embodiment will be omitted.

Figure 26:
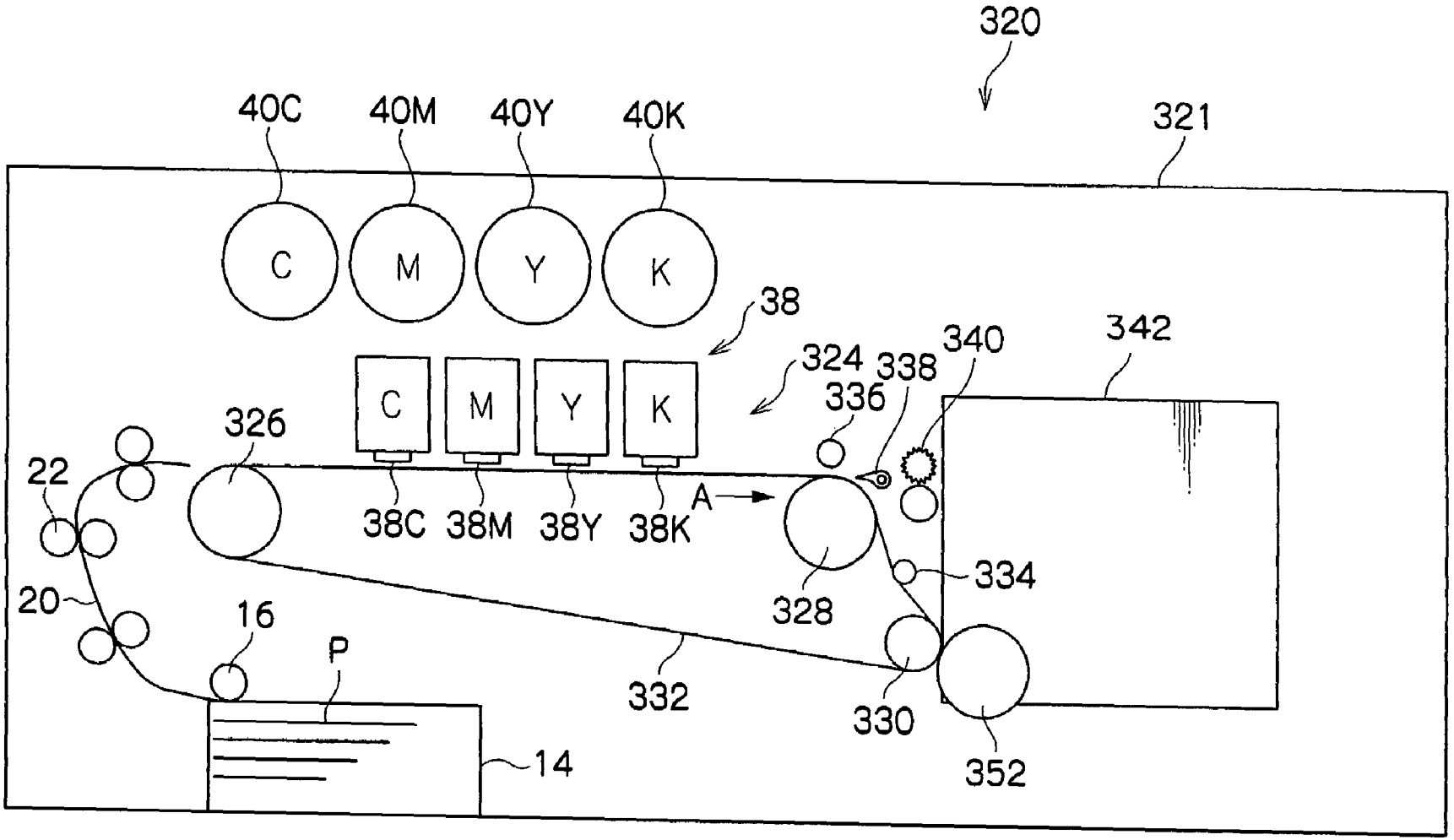
FIG. 26 is a schematic diagrammatic view showing an image recording apparatus according to an eighth embodiment of the present invention.

As shown in FIG. 26, at an approximately center portion of the body 321 of the image recording apparatus 320, there is provided a conveyor device 324 which includes a pair of rollers 326 and 328 provided at both sides of the a recording head unit 38, and a roller 330 provided rightward below the roller 328. An endless belt is entrained about the rollers 326, 328, and 330. Thus, it is structured that the roller 326 is rotationally driven by an unillustrated drive motor so that the conveyor belt 332 is rotationally moved in a predetermined direction (direction of an arrow A).

A charging roller 334 is provided between the rollers 328 and 330 in a manner to tensioningly engage the conveyance surface of the conveyor belt 332 so that the conveyor belt 332 is charged by the charging roller 334. Thus, paper P is electrostatically attracted and attached to the conveyor belt 332, and conveyed in the direction of the arrow A as the conveyor belt 332 is rotationally moved.

An unillustrated pressure roller is provided in the vicinity of the roller 326. Thus, the paper P fed from the conveying path 20 onto the conveyor belt 332 is pressed against the conveyor belt 332 by the unillustrated pressure roller .

Further, a charge-removing mechanism 336 is provided in the vicinity of the roller 328. The paper P on the conveyor belt 332 is removed from the conveyor belt 332 under the action of the charge-removing mechanism 336, and fed in the temporary stack tray 342 provided at the downstream side of the conveying direction, while being guided to a removing member 338 provided at the downstream side of the roller 328 and pressed by a spur roller 340.

Figure 27:
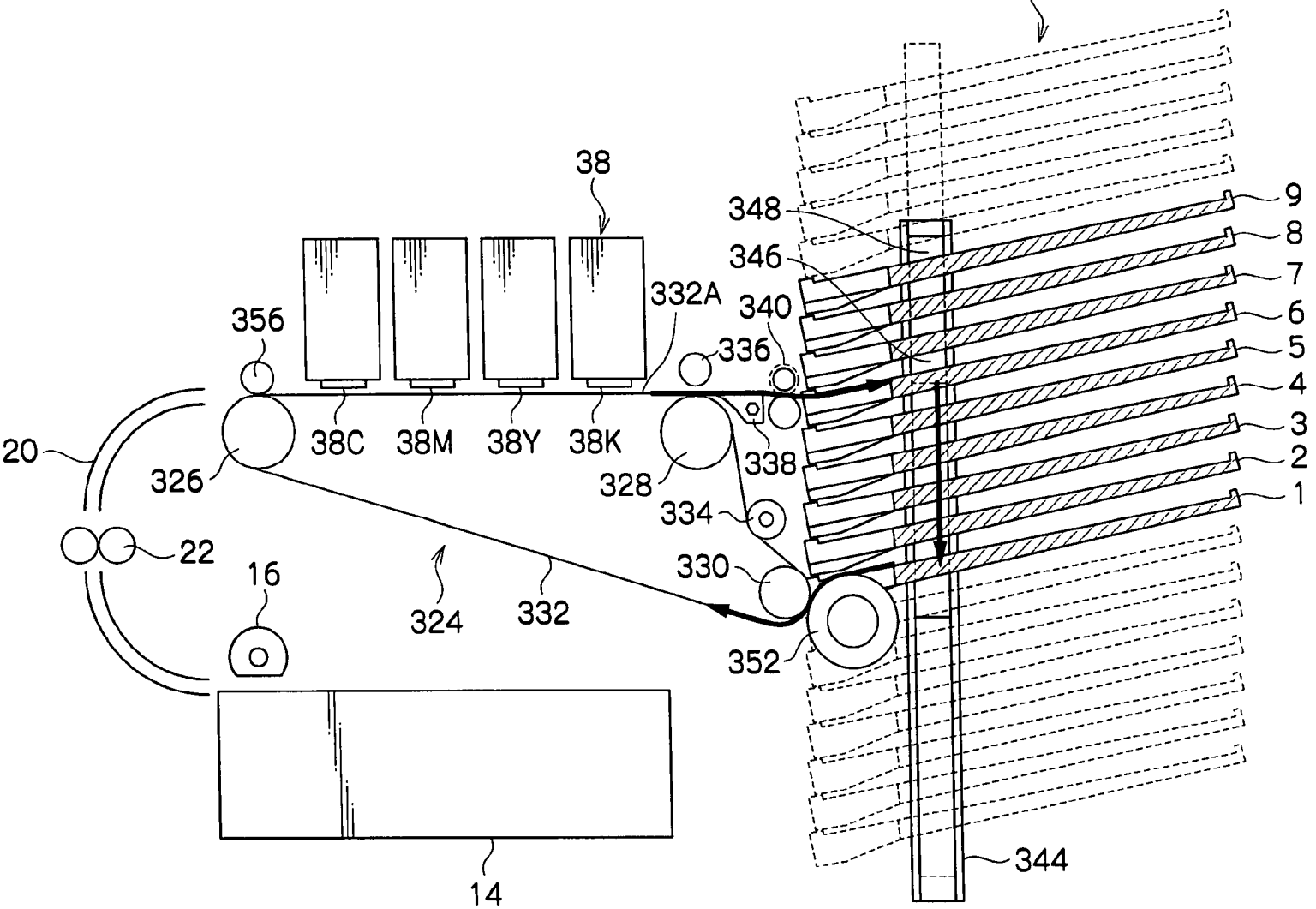
FIG. 27 is a schematic diagrammatic view of a temporary stack tray mounted in the image recording apparatus according to the eighth embodiment of the present invention.

As shown in FIG. 27, the temporary stack tray 342 includes a vertical slide rail 344 which is provided with a slide member 346 to which are fixed eight trays 1, 2, 3, 4, 5, 6, 7, and 8, and a slide member 346 to which is fixed a tray 9, the slide members 344 and 346 being vertically movable. The slide members 346 and 348 are coupled to unillustrated moving devices respectively by which the trays 1-9 are vertically moved along the slide rail 344.

Here, the configuration of the trays 1-9 will be briefly described. Meanwhile, the trays 1-9 are identically configured, and thus the tray 1 will be explained by way of example.

Figure 28:
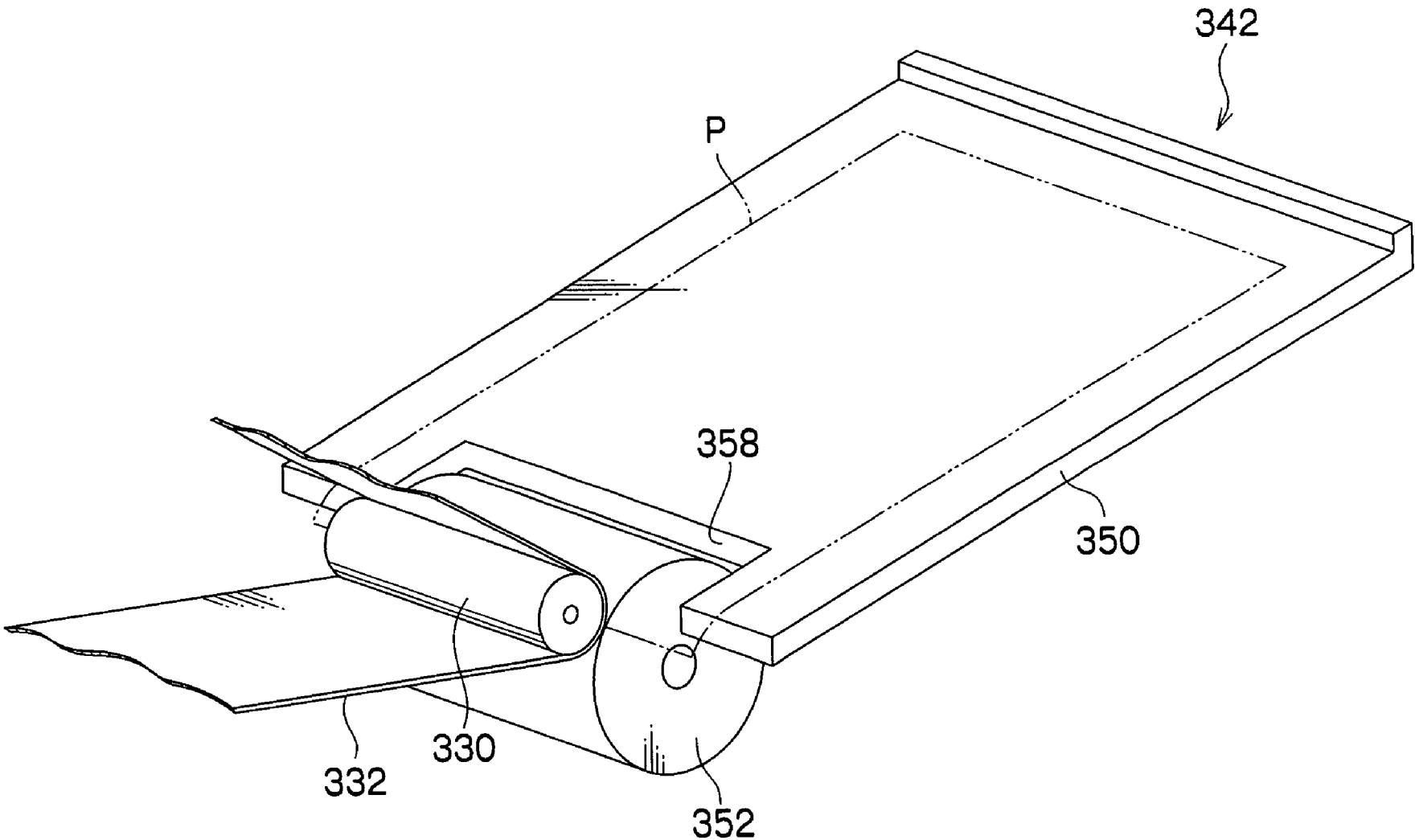
FIG. 28 is a perspective view showing the structure of the tray mounted in the image recording apparatus according to the eighth embodiment of the present invention.

As shown in FIG. 28, the tray 1 has a plate-like tray member 350 having a recess 350 formed in one end portion thereof. It is structured that a paper refeed roller 352 which is provided in the vicinity of a roller 330 below the temporary stack tray 342 protrudes from the recess 358 so that when the paper P is placed on the tray member 350, the paper P is contacted by the paper refeed roller 352 protruding from the recess 358, and discharged from the tray member 350 through rotation of the paper refeed roller 352.

That is, when the tray 1 is moved to the position where the paper reefed roller 352 is provided, the paper P accommodated on the tray 1 is picked up by the paper reefed roller 352 and taken out from the tray 1 so as to be fed onto the conveyor belt 332. Further, the paper P is electrostatically attracted and attached to the conveyor belt 332 and conveyed below the recording head unit 38 in an upside-down inverted state. Thus, an image is formed on the reverse-side surface of the paper P.

Figure 30C:
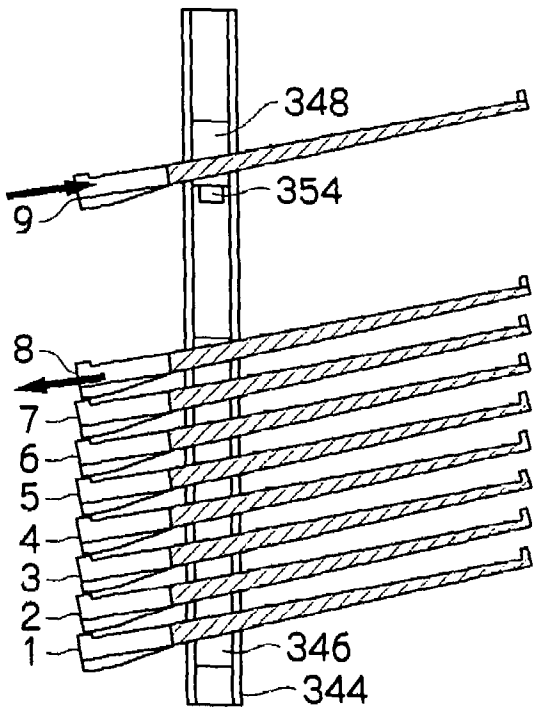
FIGS. 30A to 30C are explanatory views showing how paper-conveying is performed in the image recording apparatus according to the eighth embodiment of the present invention.

Meanwhile, as shown in FIG. 30C, a stopper member 354 is provided approximately on an extension line (paper discharge position) of the conveyance surface 332A of the conveyor belt 332. When the stopper member 354 contacts the lower surface of the slide member 48, the slide member 348 is prevented by the stopper member 354 from moving downward beyond a predetermined position. Thus, the tray 9 is prevented from moving downward beyond the paper discharge position.

On the other hand, on the reverse side of the slide member 346 is formed an unillustrated recess which is sized such that the stopper member 354 can be passed therethrough; thus, with the stopper member 354 passed through the recess, the slide member 346 is no longer prevented by the stopper member 354 from moving downward.

Figure 29:
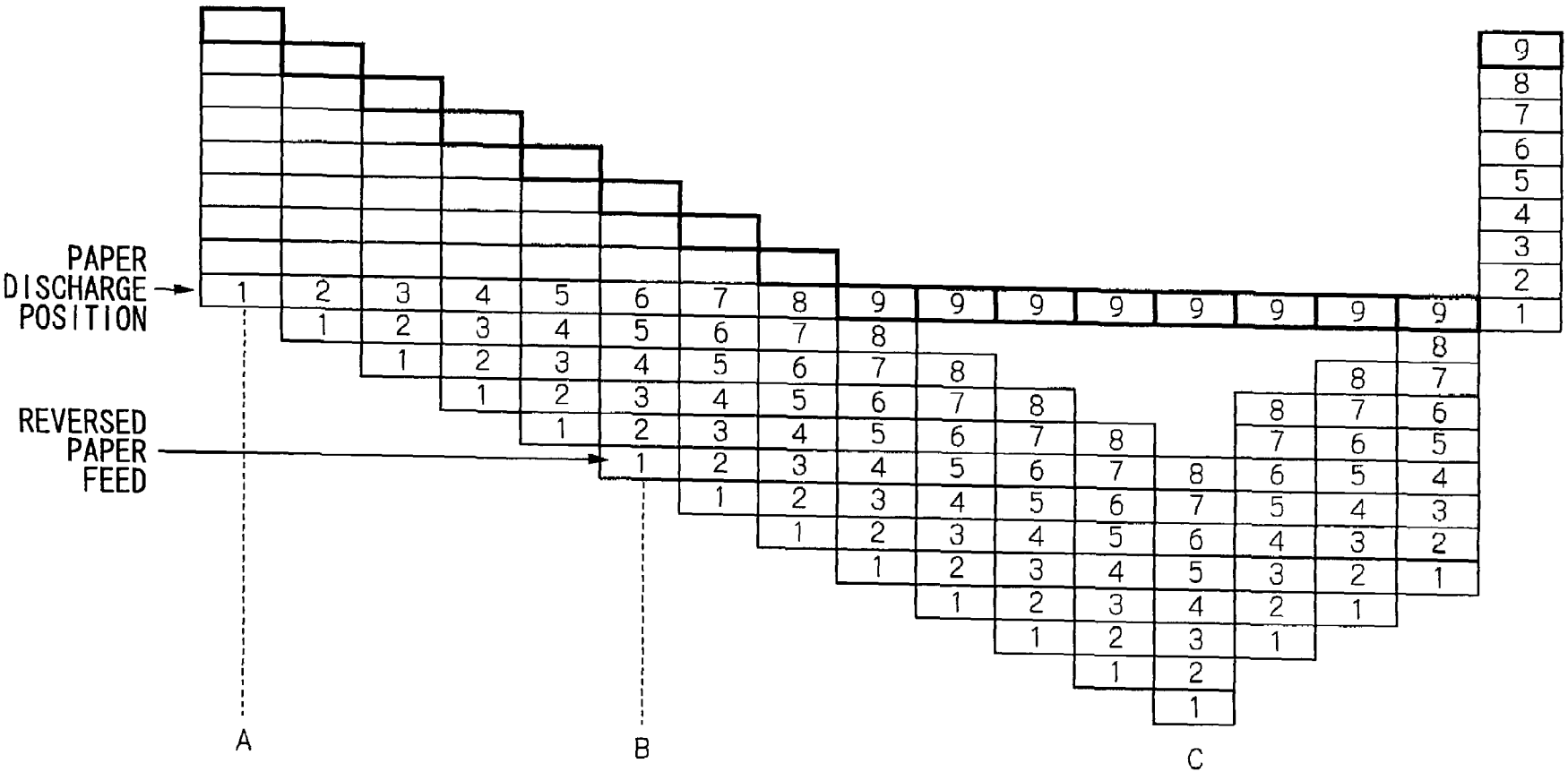
FIG. 29 is a sequence chart of the trays mounted in the image recording apparatus according to the eighth embodiment of the present invention.

Here, the conveyance path for the paper P fed in the temporary stack tray will be explained with reference to FIG. 29, showing a sequence table, and FIG. 30.

Figure 30B:
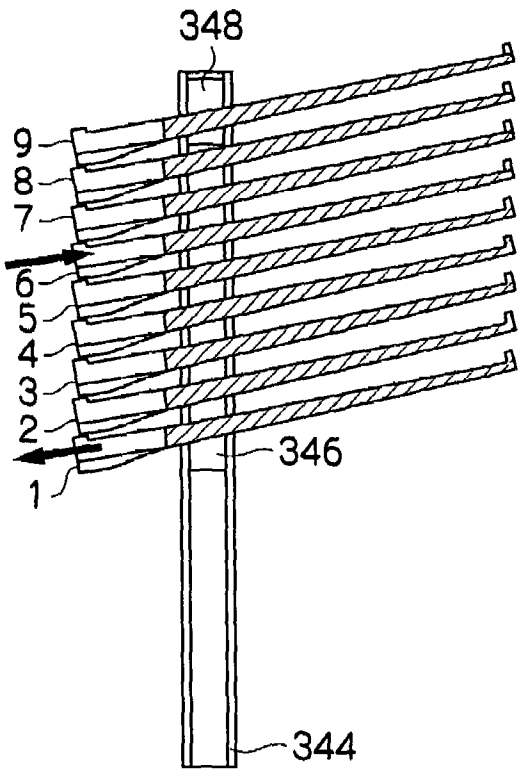
Figure 30A:
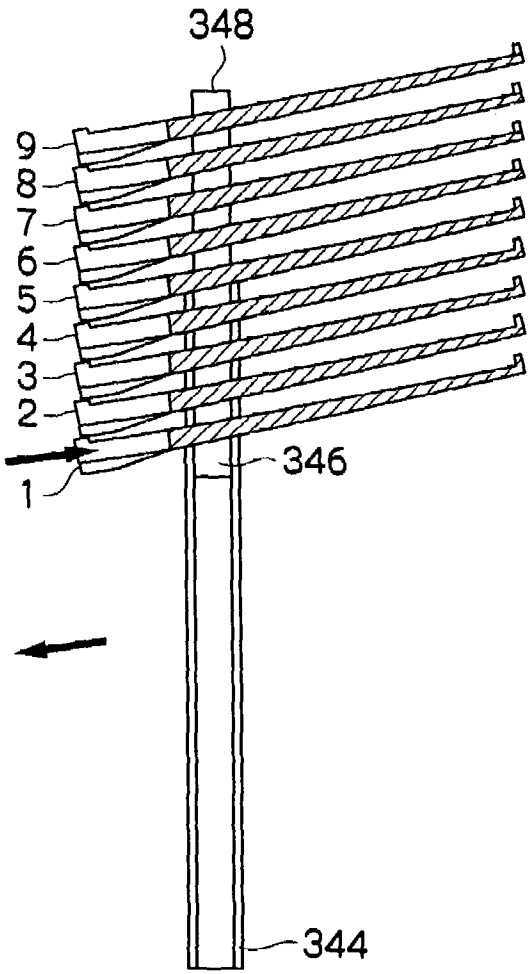

As shown in FIG. 29, first, when the tray 1 exists at the paper discharge position, paper P is fed in the tray 1 from the conveyor device 32. The state at this point is shown in FIG. 30A.

When the tray 2 is moved to the paper discharge position, paper P is fed in the tray 2. In this manner, paper P is sequentially fed in the trays 3, 4, and 5, and when the tray 6 is moved to the paper discharge position, the tray 1 is moved to a reversed paper feed position, as shown in FIG. 30B.

Here, simultaneously with paper P being fed in the tray 6, paper P is fed from the tray 1. The paper P fed from the tray 1 is formed with an image on the reverse surface thereof and discharged to an unillustrated catch tray via the tray 7. In a similar manner, papers P fed from the trays 2 and 3 and formed with an image on the reverse surface thereof are discharged to catch trays via the trays 8 and 9, respectively.

As shown in FIG. 30C, when the tray 9 is moved to the paper discharge position, the stopper member 354 is operated so that the tray 9 waits ready at the paper discharge position. Further, in this state, the trays 5, 6, 7, and 8 are sequentially moved to the reversed paper feed position so that paper P is fed, and thus the paper P having an image formed on the reverse surface thereof is discharged to the catch tray via the tray 9.

Next, when paper P is discharged from the tray 8, the trays 1-8 are moved upward in unison. Further, the tray 8 is connected to the tray 9, and the trays 1-9 are moved up to the position of FIG. 30A in one movement.

With the above structure, the paper P is dried and corrected in terms of deformation such as curl or cockle during the time that it is vertically moved while being supported on the trays 1-9

Meanwhile, in this embodiment, it is also possible to adopt a structure in which a paper attracting sheet 68, such as shown in FIG. 5B, is adhered to each of the trays 1-8 and the paper attracting sheets 68 adhered to the trays 1-8 are charged immediately before paper P is fed in the trays from the conveyor device 32. In such a structure, an electrostatic attraction force is generated at the paper attracting sheet 68 so that paper P is electrostatically attracted and attached to the paper attracting sheet 68. Further, the power supply to the paper attracting sheet 68 is interrupted before the paper P is fed in the conveyor device 324 from the trays 1-8. Thus, the electrostatic attraction force of the paper attracting sheet 68 is released so that the paper P is smoothly delivered from the trays 1-8 onto the conveyor belt 332.

Further, although not shown, the image recording apparatuses described in these embodiments include recording head controlling means that determines the timing of liquid droplet ejection in accordance with an image and the nozzle to be used, and system controlling means that controls the operation of the whole image recording apparatus.

Still further, the image recording apparatus according to the present invention is not limited to an application in which a character or an image is recorded on paper P, as in a facsimile machine, copying machine, printer, recording apparatus used as an output device for a workstation or the like, but is also equally applicable in manufacturing a color filter for a display or the like by ejecting color inks onto a high molecular film or glass, for example.

That is, the term "recording medium" used in the present invention is not limited to paper P, but it also includes OHP sheets, substrates on which a wiring pattern or the like is formed, or the like, for example. Further, the term "image" used in the present invention includes not only a common image (character, picture, photograph or the like) but also a pattern of dots (wiring pattern) formed by causing ink droplets to land on a recording medium.

While the present invention has been illustrated and described with respect to specific embodiments thereof, it is to be understood that the present invention is by no means limited thereto and encompasses various changes and modifications which will become possible without departing from the spirit and scope of the present invention.

What is claimed is:

1. An image recording apparatus for recording an image on a recording medium based on image information, comprising:

a liquid droplet ejecting head having an ejection region where liquid-ejecting nozzles are provided;

a first conveyor unit that conveys the recording medium through a recording area which faces the ejecting region and in which an image is recorded on one side of the recording medium;

a paper discharge section to which the recording medium is fed from the first conveyor unit;

a plurality of holding units comprising attracting and supporting members, each holding unit of which receives the one-side-recorded recording medium fed from the first conveyor unit at a receiving position, attaches a non-recorded side of the one-side-recorded recording medium and holds the recording medium by attracting the recording medium, and is aligned each other for substantially vertical direction;

a moving unit comprising a movement mechanism that moves each of the plurality of holding units substantially vertically between the receiving position and a feeding position;

a belt that is circulated vertically in response to movement of the movement mechanism;

a moveable step portion that is mounted to the belt and supports free ends of the attracting and supporting members; and a second conveyor unit that receives the one-side-recorded recording medium from one of the plurality of holding units positioned at the feeding position and feeds the recording medium to the first conveyor unit so that non-recorded side of the one-side-recorded recording medium faces the ejecting region in the recording area.

2. The image recording apparatus according to claim 1, wherein:

the movement mechanism is circulated substantially vertically, and a support member is formed substantially vertically with step portions;

the attracting and supporting members are mounted to the movement mechanism with a predetermined spacing; and the step portions support free ends of the attracting and supporting members.

3. The image recording apparatus according to claim 2, wherein the attracting and supporting unit comprises an attracting electrode connected to a voltage applying mechanism, and wherein the attracting electrode has the generation of an attracting and supporting force in accordance with a voltage supply from the voltage applying mechanism.

4. The image recording apparatus according to claim 1, wherein;

the plurality of holding units comprises foldable attracting and supporting trays that attract and support the recording medium;

the moving unit comprises a movement mechanism that is circulated vertically, support pedestals that support mounted portions of the attracting and supporting trays and that are provided on the movement mechanism, and backing plates that prevent the attracting and supporting trays from being folded backwards and that are provided at a foldable portion of the attracting and supporting trays; and the foldable attracting and supporting trays being rotatably mounted to the movement mechanism with a predetermined spacing.

5. The image recording apparatus according to claim 4, wherein the foldable attracting and supporting trays comprise an attracting electrode connected to a voltage applying mechanism, and wherein the attracting electrode has the generation of an attracting and supporting force in accordance with a voltage supply from the voltage applying mechanism.

6. The image recording apparatus according to claim 1, wherein:

the plurality of holding units comprises attracting and supporting sheets that attract and support the recording medium;

the moving unit comprises an upstream side roll conveyor mechanism in which upstream side sheet rolls capable of winding and unwinding the attracting and supporting sheet are provided vertically at plural stages, a downstream side roll conveyor mechanism in which downstream side sheet rolls capable of winding and unwinding the attracting and supporting sheets are provided vertically at plural stages, the downstream side roll conveyor mechanism being provided downstream of the upstream side roll conveyor mechanism, and a control mechanism that causes the recording medium to be moved downward and conveyed to a subsequent step by repeating:

receiving the recording medium by unwinding one of the attracting and supporting sheets from the upstream side sheet rolls;

delivering the recording medium to one of the attracting supporting sheets of the downstream side sheet rolls by unwinding the attracting and supporting sheet from the downstream side sheet roll and winding up the upstream side sheet roll; and delivering the recording medium to one of the attracting supporting sheets of the upstream side sheet rolls by unwinding the attracting and supporting sheet from the upstream side sheet roll winding up the upstream side sheet roll.

7. The image recording apparatus according to claim 6, wherein the attracting and supporting sheet comprises an attracting electrode connected to a voltage applying mechanism, and wherein the attracting electrode has the generation of an attracting and supporting force in accordance with a voltage supply from the voltage applying mechanism.

8. The image recording apparatus according to claim 1, wherein:

the plurality of holding units comprise upstream side attracting trays and downstream side attracting trays;

the moving unit comprises an upstream side stationary accommodating member in which the upstream side attracting trays are provided with a predetermined spacing at plural stages, a downstream side movable accommodating member in which the downstream side attracting trays inclined downward in a manner to intrude between the upstream side trays are provided with a predetermined spacing at plural stages, and a slide mechanism that causes the downstream side movable accommodating member to be moved at a predetermined timing in an approaching direction or in a departing direction with respect to the upstream side stationary accommodating member.

9. The image recording apparatus according to claim 8, wherein each tray of the upstream side attracting trays and the downstream side attracting trays comprises an attracting electrode connected to a voltage applying mechanism, and wherein the attracting electrode has the generation of an attracting and supporting force in accordance with a voltage supply from the voltage applying mechanism.

10. The image recording apparatus according to claim 1, wherein:

the plurality of holding units comprises attracting and supporting arms that attract and support edges of the recording medium, the attracting and supporting arms being provided at opposite edges of the recording medium; and the moving unit comprises an arm support member to which the attracting and supporting arms are mounted substantially vertically with a predetermined spacing, the arm support member being structured so as to cause attracting and supporting arms opposing each other to be moved apart from each other while causing the attracting and supporting arms to be moved downward.

11. The image recording apparatus according to claim 1, wherein:

the plurality of holding units comprise attracting and supporting plates that attract and support edges of the recording medium, the attracting and supporting plates being provided at opposite edges of the recording medium; and the moving unit comprises first gears to which the attracting and supporting plates are mounted, second gears that mesh with the first gears, third gears having the second gears mounted in coaxial relationship thereto, a chain member that causes the third gears located at opposite edges of the recording medium to be moved apart from each other while causing the third gears to be moved downward, and fourth gears that mesh with the third gears so as to cause the third gears to be forcibly rotated with respect to the chain member and maintain an attitude of the attracting and supporting plates when the third gears opposing each other are moved apart from each other.

12. The image recording apparatus according to claim 11, wherein a relational expression $r_0/r_1=r_3/r_2$ holds, where the first to fourth gears have an identical tooth size; the first gear has a radius of rotation $r_3$; the second gear has a radius of rotation $r_2$; the third gear has a radius of rotation $r_1$; and the fourth gear has a radius of rotation $r_0$.

13. The image recording apparatus according to claim 1, wherein:

the plurality of holding units comprises a plurality of attracting and supporting trays provided vertically; and the moving unit comprises a control unit control that moves the attracting and supporting trays such that the attracting and supporting trays receive the recording mediums sequentially at the receiving position, are moved vertically, and discharge the recording mediums sequentially at the feeding position.

14. The image recording apparatus according to claim 13, wherein the attracting and supporting comprises an attracting electrode connected to a voltage applying mechanism, and wherein the attracting electrode has the generation of an attracting and supporting force in accordance with a voltage supply from the voltage applying mechanism.

15. The image recording apparatus according to claim 1, wherein the holding unit comprises an attracting electrode connected to a voltage applying mechanism, and wherein the attracting electrode has the generation of an attracting and supporting force in accordance with a voltage supply from the voltage applying mechanism.

16. An image recording apparatus wherein an image is recorded on a recording medium based on image information by ejecting liquid droplets from a liquid droplet ejecting head, comprising:

a liquid droplet ejecting head having an ejection region substantially corresponding to a width of the recording medium;

a conveyor unit that conveys the recording medium to the ejection region of the liquid droplet ejecting head with the recording medium electrostatically attracted and attached thereto and supported thereon, the conveyor unit including an endless belt;

a paper discharge section to which the recording medium is fed from the conveyor unit; and a plurality of electrostatically attracting and supporting sub-units, within an electrostatically attracting and supporting unit, that are substantially vertically moved with the recording medium, which is delivered thereto from the conveyor unit, electrostatically attracted and attached thereto and supported thereon, thereby conveying the recording medium to a subsequent step;

the electrostatically attracting and supporting unit receives the recording medium on which an image has been formed by the liquid droplet ejecting head, moves vertically while electrostatically attracting the recording medium thereon, and feeds the recording medium to a conveying path that returns the recording medium to the upstream side of the liquid droplet ejecting head.

* * * * *